US012487041B2

(12) United States Patent
Royce et al.

(10) Patent No.: US 12,487,041 B2
(45) Date of Patent: Dec. 2, 2025

(54) MAGAZINE BASE PAD

(71) Applicant: Grip Force LLC, Chardon, OH (US)

(72) Inventors: Frank J. Royce, Chardon, OH (US); William H. Rogers, St. Augustine, FL (US); Zachary H. Wells, Waynesville, NC (US)

(73) Assignee: Grip Force LLC, Chardon, OH (US)

( * ) Notice: Subject to any disclaimer, the term of this patent is extended or adjusted under 35 U.S.C. 154(b) by 0 days.

(21) Appl. No.: 18/634,205

(22) Filed: Apr. 12, 2024

(65) Prior Publication Data

US 2024/0344793 A1 Oct. 17, 2024

Related U.S. Application Data

(60) Provisional application No. 63/495,893, filed on Apr. 13, 2023.

(51) Int. Cl.
*F41A 9/70* (2006.01)
*F41A 9/71* (2006.01)

(52) U.S. Cl.
CPC .. *F41A 9/70* (2013.01); *F41A 9/71* (2013.01)

(58) Field of Classification Search
CPC ..... F41A 9/61; F41A 9/65; F41A 9/71
USPC ..... 42/49.01, 50
See application file for complete search history.

(56) References Cited

U.S. PATENT DOCUMENTS

D401,992 S 12/1998 Pearce
5,979,015 A 11/1999 Tamaribuchi
6,598,302 B1 7/2003 Peppel et al.
7,304,636 B2 12/2007 Willat et al.
D593,634 S 6/2009 Fitzpatrick et al.
D642,647 S 8/2011 Fitzpatrick et al.
8,151,504 B1 4/2012 Aiston
D745,944 S 12/2015 Kielsmeier et al.
D769,397 S 10/2016 Lam et al.
9,772,151 B1 9/2017 Sanderson et al.
(Continued)

FOREIGN PATENT DOCUMENTS

EM 015037012-001 10/2023
EM 015037012-002 10/2023
EM 015037012-003 10/2023

OTHER PUBLICATIONS

HYVE Technologies webpage for +5 Mag Base Pad for the GLOCK™ 17/34; https://hyve-technologies.com/product/5-mag-base-pad-for-the-glock-17-34/; Printed Apr. 6, 2023.
(Continued)

*Primary Examiner* — Reginald S Tillman, Jr.
(74) *Attorney, Agent, or Firm* — Wood Herron & Evans LLP

(57) ABSTRACT

A firearm magazine base pad comprises a base pad body adapted to be removably secured to a lower end of a magazine body, the base pad body including a front portion, a rear portion, a pair of opposed side portions, and a lower portion. The lower portion of the base pad body, when viewed in a cross-sectional plane parallel to and medially of the opposed side portions and in a cross-sectional plane perpendicular to the opposed side portions and medially of the front and rear portions, is convex. The front portion of the base pad body, when viewed in a cross-sectional plane parallel to and medially of the opposed side portions, is concave.

17 Claims, 16 Drawing Sheets

(56) References Cited

U.S. PATENT DOCUMENTS

| | | | | |
|---|---|---|---|---|
| 9,857,130 | B2 * | 1/2018 | Purkiss | F41A 9/61 |
| 10,190,835 | B2 | 1/2019 | Hsu et al. | |
| 10,317,153 | B2 * | 6/2019 | Faifer | F41A 9/71 |
| D855,736 | S * | 8/2019 | Sroufe | D22/108 |
| 10,520,268 | B1 | 12/2019 | Viani | |
| D889,587 | S | 7/2020 | Wallgren | |
| D970,679 | S | 11/2022 | Mei | |
| 11,662,165 | B1 | 5/2023 | Viani | |
| D1,004,733 | S | 11/2023 | Kedairy | |
| 2004/0031181 | A1 | 2/2004 | Freed | |
| 2011/0107643 | A1 | 5/2011 | Fitzpatrick et al. | |
| 2013/0152343 | A1 | 6/2013 | Doherty et al. | |
| 2015/0309595 | A1 | 10/2015 | Ng | |
| 2023/0070228 | A1 * | 3/2023 | Kellgren | F41A 9/65 |
| 2023/0266084 | A1 | 8/2023 | Oaks et al. | |

OTHER PUBLICATIONS

Strike Industries webpagefor Aluminum Extensed Magazine Plate for Glock™ G17 (9mm) / G22 (.40cal); https://www.strikeindustries.com/si-emp-al-g17.html; Printed Apr. 6, 2023.

Midway USA webpage featuring Strike Industries EMP Enhanced Magazine Plate Magaine Base Pad GLOCK™ 26 +2 Polymer Black; https://www.midwayusa.com/product/1023154284; Printed Apr. 6, 2023.

Strike Industries webpage for Spare Parts for Extended Magazine Plate for GLOCK™ g26; https://www.strikeindustries.com/part-emp-g26.html; Printed Apr. 6, 2023.

FN America LLC webpage for FNX™-45 Tactical FDE; //fnamerica.com/products/pistols/fnx-45-fde/; Printed Apr. 6, 2023.

* cited by examiner

MAGAZINE BASE PAD

RELATED APPLICATIONS

This application claims the priority benefit of U.S. Provisional Patent Application No. 63/495,893 filed Apr. 13, 2023, which is hereby incorporated by reference herein as if fully set forth in its entirety.

FIELD OF THE INVENTION

The present invention relates generally to semi-automatic firearm accessories, and more particularly to magazine base pads for use on box magazines for semi-automatic firearms.

BACKGROUND OF THE INVENTION

Conventional semi-automatic pistol magazine base pads are mostly squared-off or rectangular, with angled or flat sides and a flat bottom. These non-ergonomic shapes do not provide the proper surface contact or tactile (touch) feedback to the shooter/operator's hand, especially when handling and using the base pad at speed.

So-called "extended" magazine base pads are also known. Extended magazine base pads are referred to as such due to the fact that the base pad extends downwardly from the lower end of the magazine body more than the typical flat bottom base pad, or because they extend or increase the capacity of the magazine, or both.

The conventional shapes and designs of both of these known base pads do not optimize the fitment between the base pad, magazine body, and the shooter's hand. Due to this fact, the user of such conventional products can cause undue stress or injury to themselves by using a product with an inferior design.

The lack of a proper ergonomic design of the base pad can result in less tactile feedback to the operator/shooter. Due to this lack of feedback, the end user may utilize excess force, and improper reload technique, while attempting to insert, seat, and lock the magazine into the pistol.

From a perspective of Military, Law Enforcement, and Civilian self-defense situations, the end user must be able to complete a proper reload in the fastest, most efficient manner possible. The speed of the reload sequence can directly affect how quickly an end user can deliver fast, effective fire onto an adversary in a defensive situation. The same enhanced speed and efficiency elements also apply to competition shooting sports, though those are much less important than a life-or-death defensive situation.

Accordingly, one objective is to provide a magazine base pad with a more ergonomic shape and design which can help eliminate technique and overuse of force errors.

Another objective is to provide a magazine base pad that reduces or eliminates the detrimental factors one experiences when using a product with a conventional base pad design.

Another objective is to provide a magazine base pad that takes into account how the human hand and other parts of the body interact with the body of the magazine and the magazine base pad.

Another objective is to provide a magazine base pad that makes the connection between the shooter's body and the base pad as stable and strain resistant as possible.

Another objective is to provide a magazine base pad that optimizes and makes seamless the connection between the hand's fingers, palm, and thumb and the base pad and magazine body, and ultimately the connection between the wrist, forearm, elbow, and shoulder.

SUMMARY OF THE INVENTION

In one aspect, a firearm magazine base pad comprises a base pad body adapted to be removably secured to a lower end of a magazine body, the base pad body including a front portion, a rear portion, a pair of opposed side portions, and a lower portion, wherein the lower portion of the base pad body, when viewed in a cross-sectional plane parallel to and medially of the opposed side portions, is convex, wherein the lower portion of the base pad body, when viewed in a cross-sectional plane perpendicular to the opposed side portions and medially of the front and rear portions, is convex, and wherein the front portion of the base pad body, when viewed in a cross-sectional plane parallel to and medially of the opposed side portions, is concave.

In another aspect, a firearm magazine base pad comprises a base pad body adapted to be removably secured to a lower end of a magazine body, the base pad body including a front portion, a rear portion, a pair of opposed side portions, and a lower portion, wherein each side portion of the base pad body includes a generally rectangular recess, the recess having upper and lower longer side edges and front and rear shorter side edges, the upper side edge including an arcuate recess extending upwardly therefrom.

In another aspect, a firearm magazine base pad comprises a base pad body adapted to be removably secured to a lower end of a magazine body, the base pad body including a front portion, a rear portion, a pair of opposed side portions, and a lower portion, each side portion of the base pad body including a channel at an upper edge thereof adapted to slidably receive a flange on a lower edge of a side wall of the magazine body, a locking member having at least one post extending therefrom, and the base pad body having at least one hole in an upper edge of the rear portion thereof, the post received in the hole whereby the locking member prevents removal of the magazine body flanges from the base pad body channels.

In another aspect, a firearm magazine base pad comprises a base pad body adapted to be removably secured to a lower end of a magazine body, the base pad body including a front portion, a rear portion, a pair of opposed side portions, and a lower portion, wherein the lower portion of the base pad body, when viewed in a cross-sectional plane parallel to and medially of the opposed side portions, is convex, and wherein the lower portion of the base pad body, when viewed in a cross-sectional plane perpendicular to the opposed side portions and medially of the front and rear portions, is convex.

The accompanying drawings, which are incorporated in and constitute a part of this specification, illustrate embodiments of the invention and, together with the summary of the invention given above, and the detailed description of the drawings given below, serve to explain the principles of the present invention.

DETAILED DESCRIPTION OF THE DRAWINGS

Figure 1:
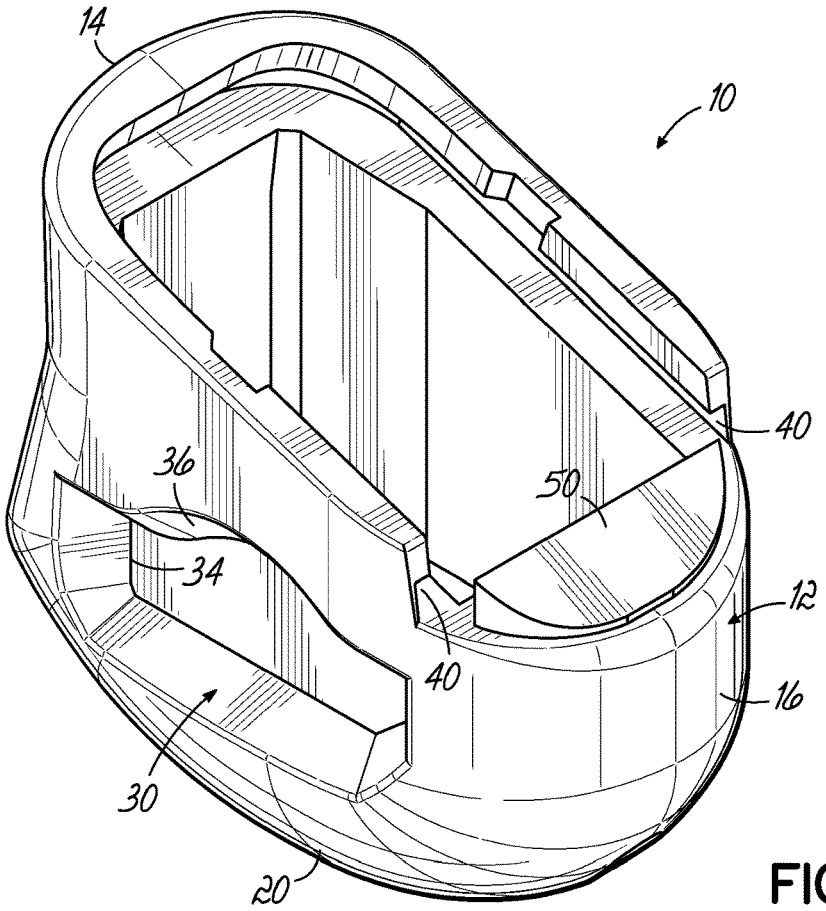
FIG. 1 is a top rear left perspective view of the ergonomic magazine base pad of the present invention.
Figure 2:
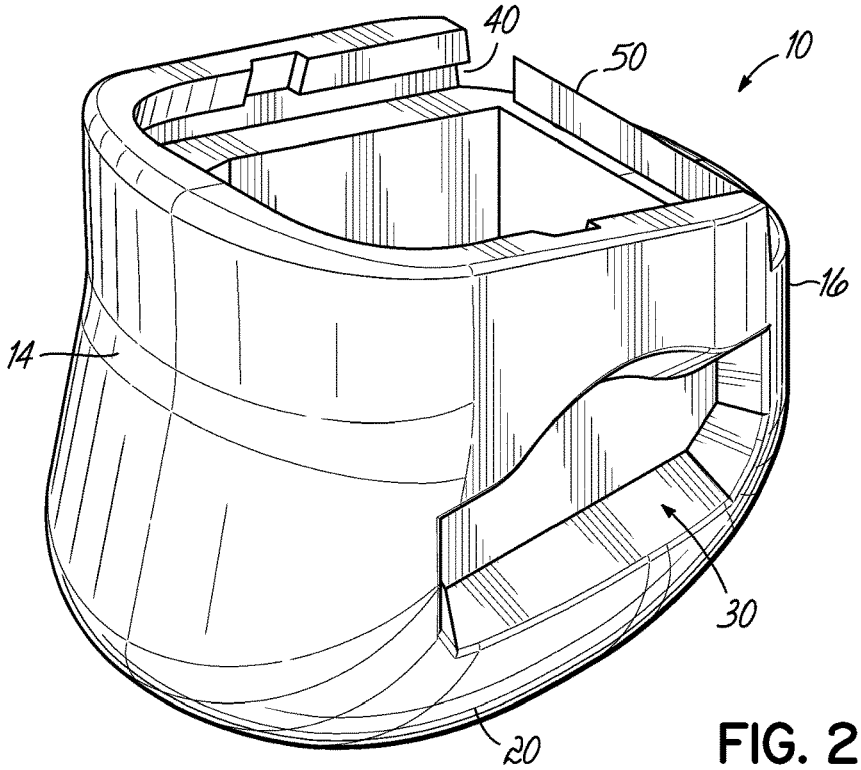
FIG. 2 is a top front left perspective view thereof.
Figure 3:
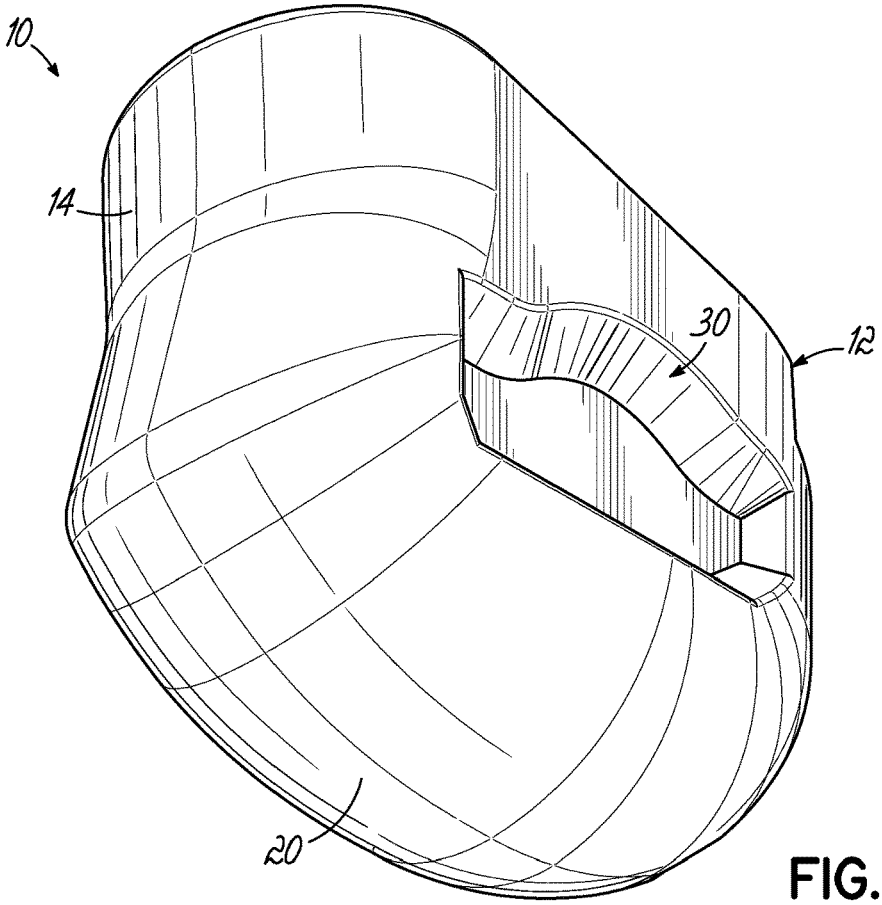
FIG. 3 is a bottom front left perspective view thereof.
Figure 4:
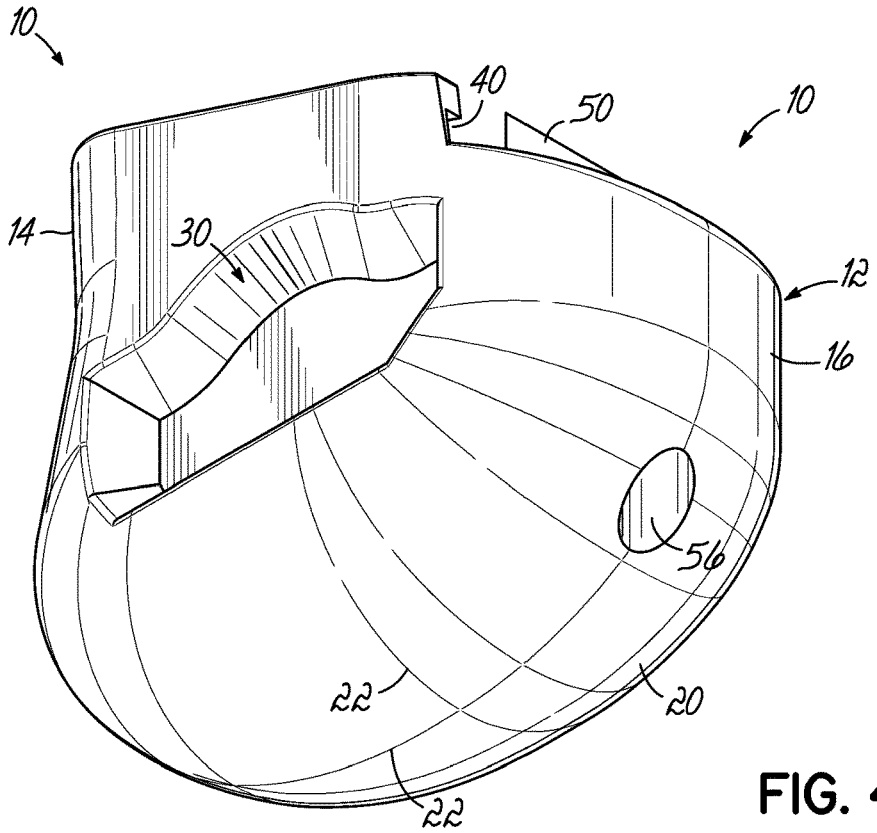
FIG. 4 is a bottom rear left perspective view thereof.
Figure 5:
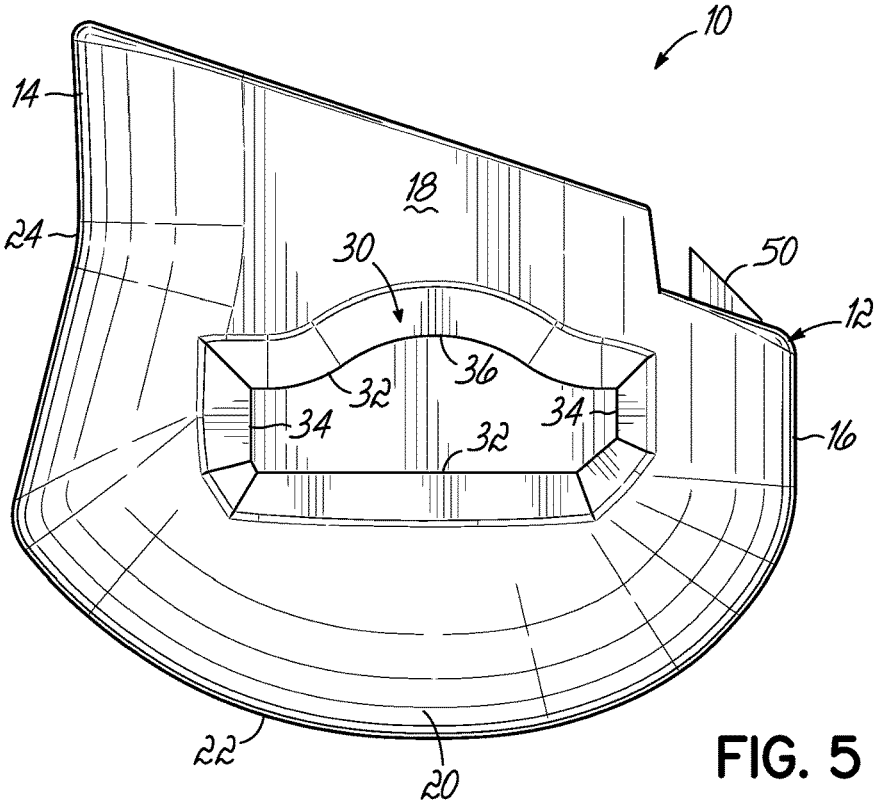
FIG. 5 is a left side view thereof.
Figure 6:
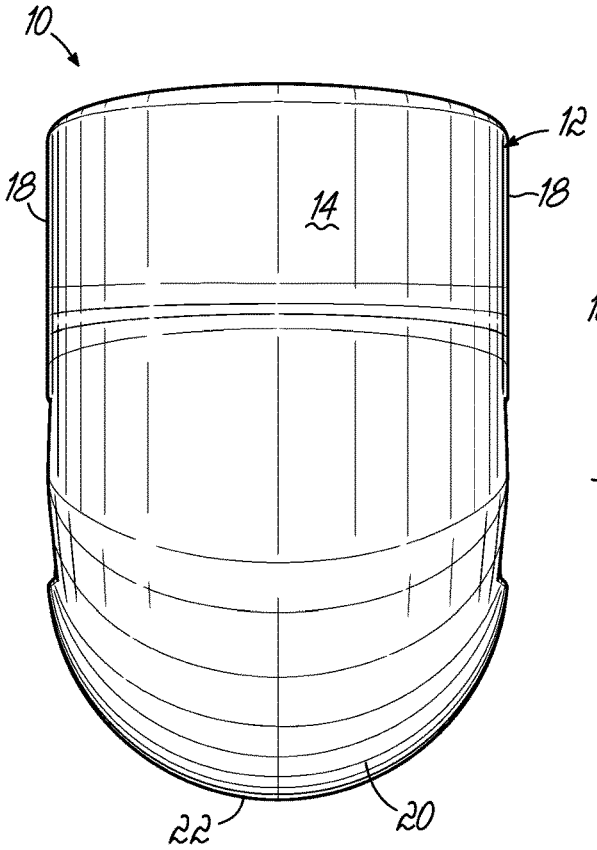
FIG. 6 is a front view thereof.
Figure 7:
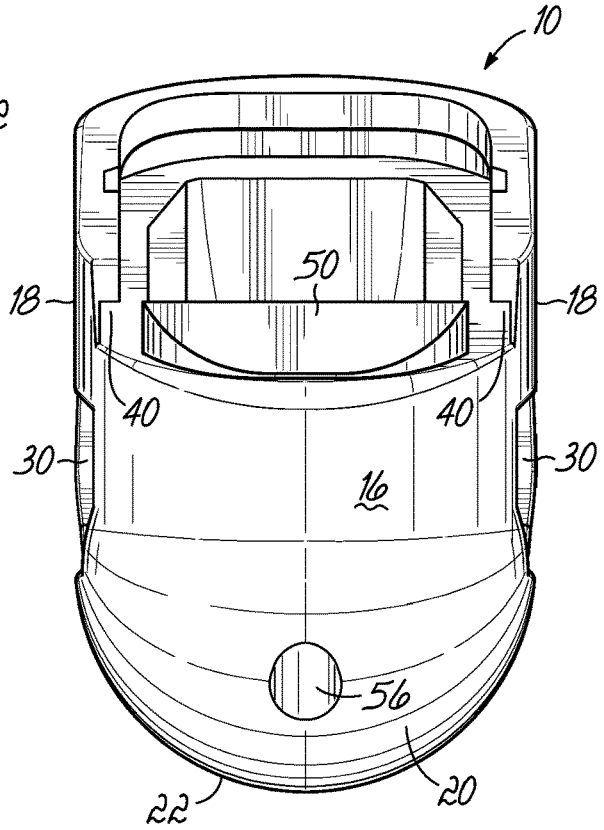
FIG. 7 is a rear view thereof.
Figure 8:
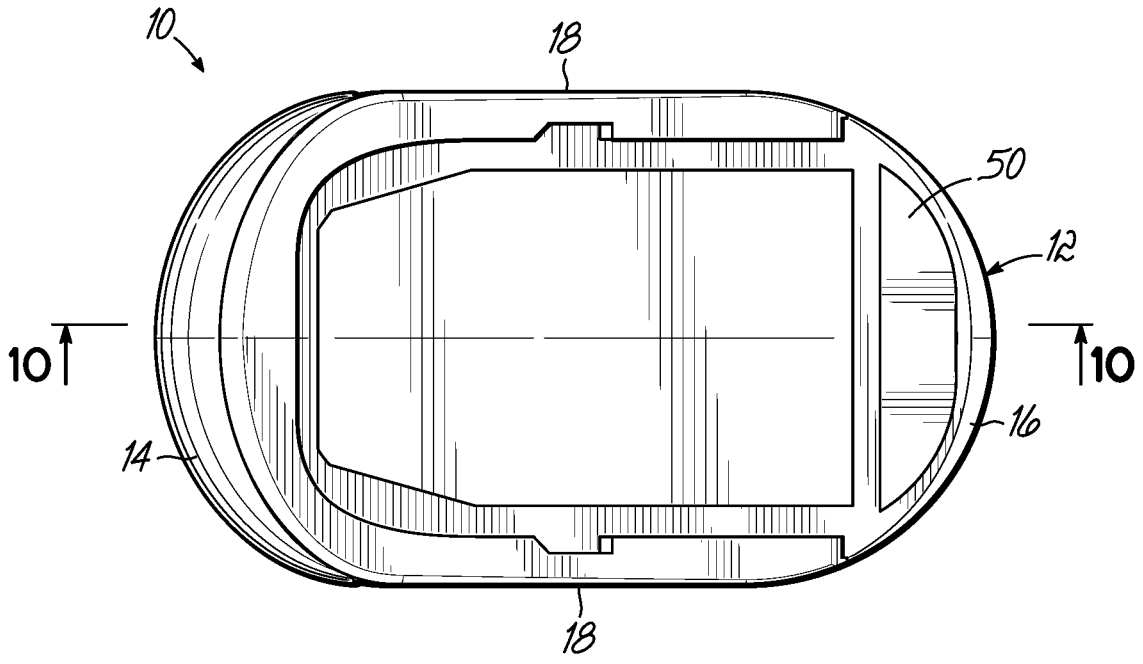
FIG. 8 is a top view thereof.
Figure 9:
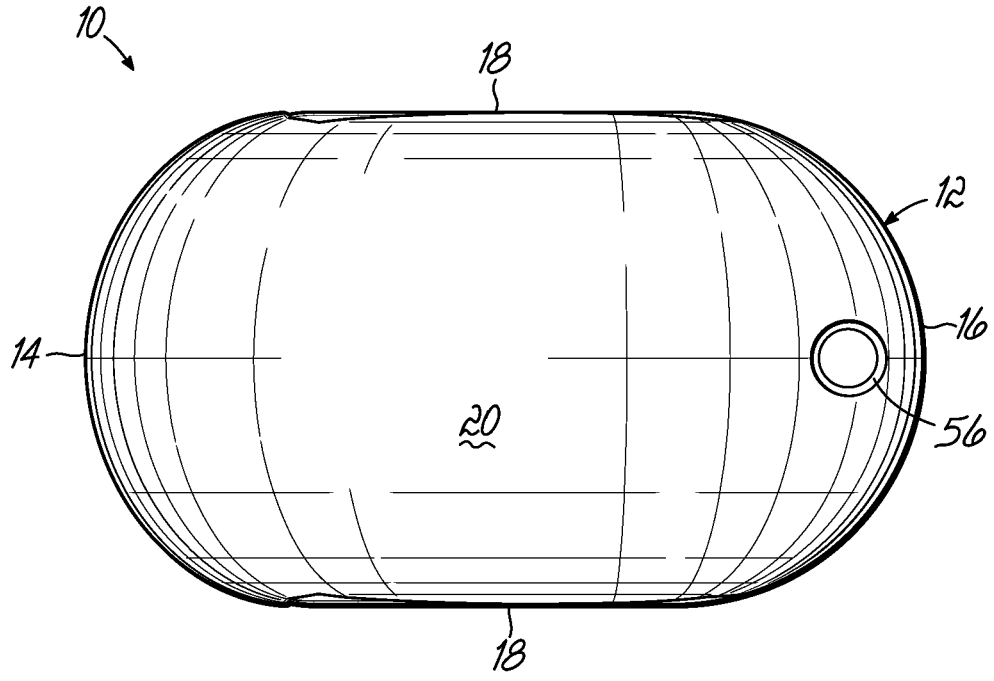
FIG. 9 is a bottom view thereof.

The magazine base pad described herein has an ergonomic design/shape that works with the shooter's body, specifically the hand. It provides the operator with more surface contact points while using the product. The operator can feel these extra contact points, enhancing the body's ability to sense the base pad's location and adjust its movements and actions. That is especially true regarding the position of the magazine (its body and base pad) relative to where the pistol receiver (specifically the magazine well) is. That enhances the operator's ability to direct the magazine into the pistol (insert, seat, and lock) more quickly and efficiently.

The magazine base pad as described herein includes an ergonomic magazine base pad having enhanced features. These features aid the end user in the reload process. They can improve how the user's hand indexes, grips, orients, inserts, seats, and locks a magazine into a semi-automatic pistol. They can also reduce or eliminate stress or excess force-related injuries that conventionally designed "flat bottomed" or "extended" magazine base pads can cause. They achieve an optimum ergonomic relationship between the various parts of the human hand, including the palm, thumb, fingers, and finger pads. This optimum ergonomic relationship between the magazine, base pad, magazine body, and the shooter's hand offers improved sensory feedback that can also benefit the entire arm—specifically, the wrist, forearm, elbow, and shoulder of the hand operating the magazine. This improved feedback allows the user to recognize and properly adjust the upward force exerted on the base pad as they insert, seat, and lock the magazine into the pistol. Better control of this force applied to the magazine, base pad, and magazine body can prevent too much force from being imparted on the base pad and the magazine slamming into the pistol. That repeated slamming effect can produce stress-related injuries. This better control of that force not only reduces or eliminates stress or excess force-related injuries to the hand but can also reduce or eliminate stress or excess force-related injuries to the wrist, forearm, elbow, and shoulder.

The magazine base pad as described herein has an enhanced design which improves the ergonomic shape of the magazine base pad and how it functions with the human hand. The various improvements aid the user, specifically in how they can index, grip, and manipulate the base pad and magazine. Specific versions of the ergonomic base pad increase the magazine's capacity by acting as an extension of the area where the ammunition is stored and fed.

Throughout this document, reference is made to the drawing figures. The figures detail particular embodiments of the invention. Throughout this document, reference to "an embodiment," "one embodiment," or "certain embodiments" means that a particular feature, structure, or characteristic described may be included in at least one embodiment. Thus, the appearances of the expressions "in an embodiment," "in one embodiment," or "in certain embodiments" at various places throughout this description do not necessarily all refer to the same embodiments.

Further, the described features, structures, and characteristics may be combined in any suitable manner in one or more embodiments. Based on the disclosure herein, those knowledgeable in the discipline will recognize that the various embodiments may be practiced without one or more specific details or other methods, components, materials, and the like. In some instances, known structures, materials, or operations are not shown or described in detail to avoid obscuring aspects of the embodiments. The present invention is described in enabling detail in the following examples, which may represent more than one embodiment of the present invention.

Figure 10:
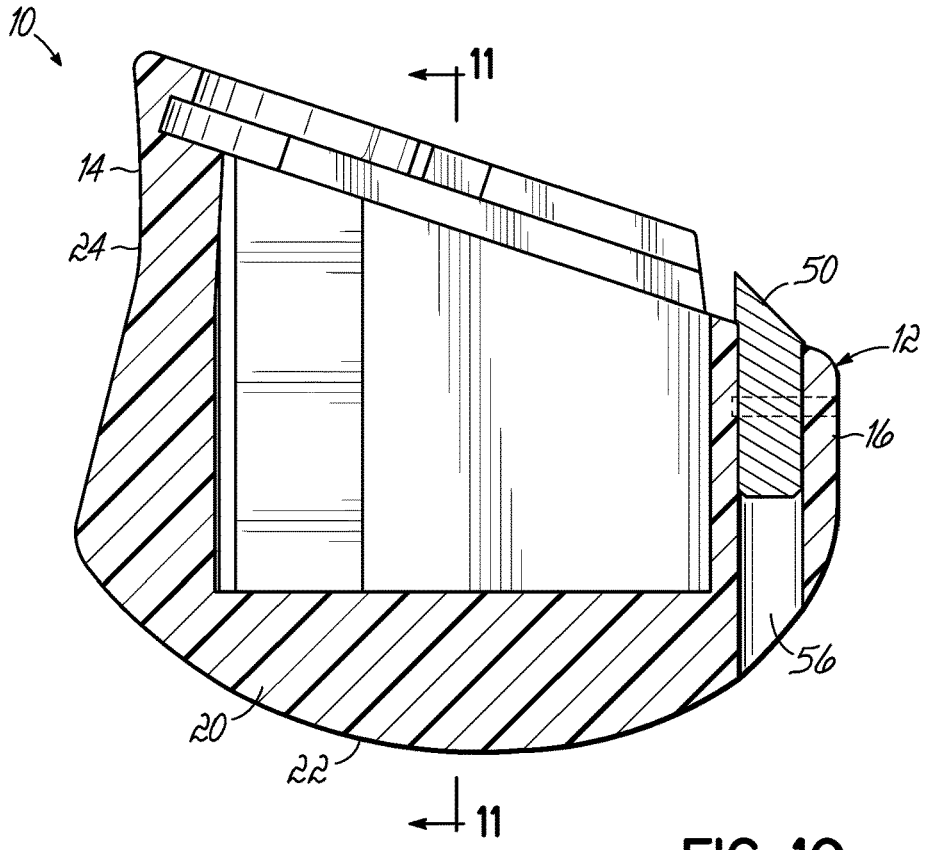
FIG. 10 is a cross-sectional view taken along line 10-10 in FIG. 8.
Figure 11:
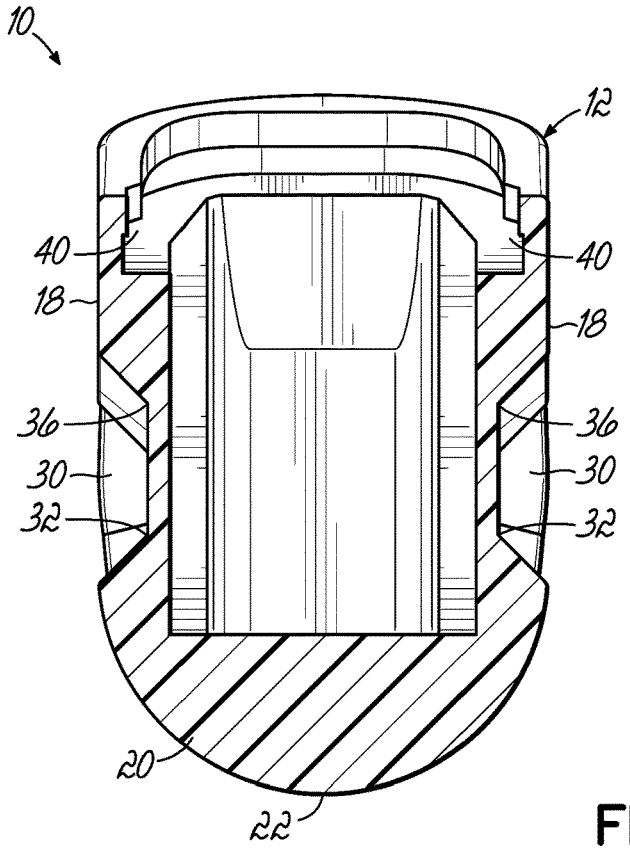
FIG. 11 is a cross-sectional view taken along line 11-11 in FIG. 10.
Figure 12:
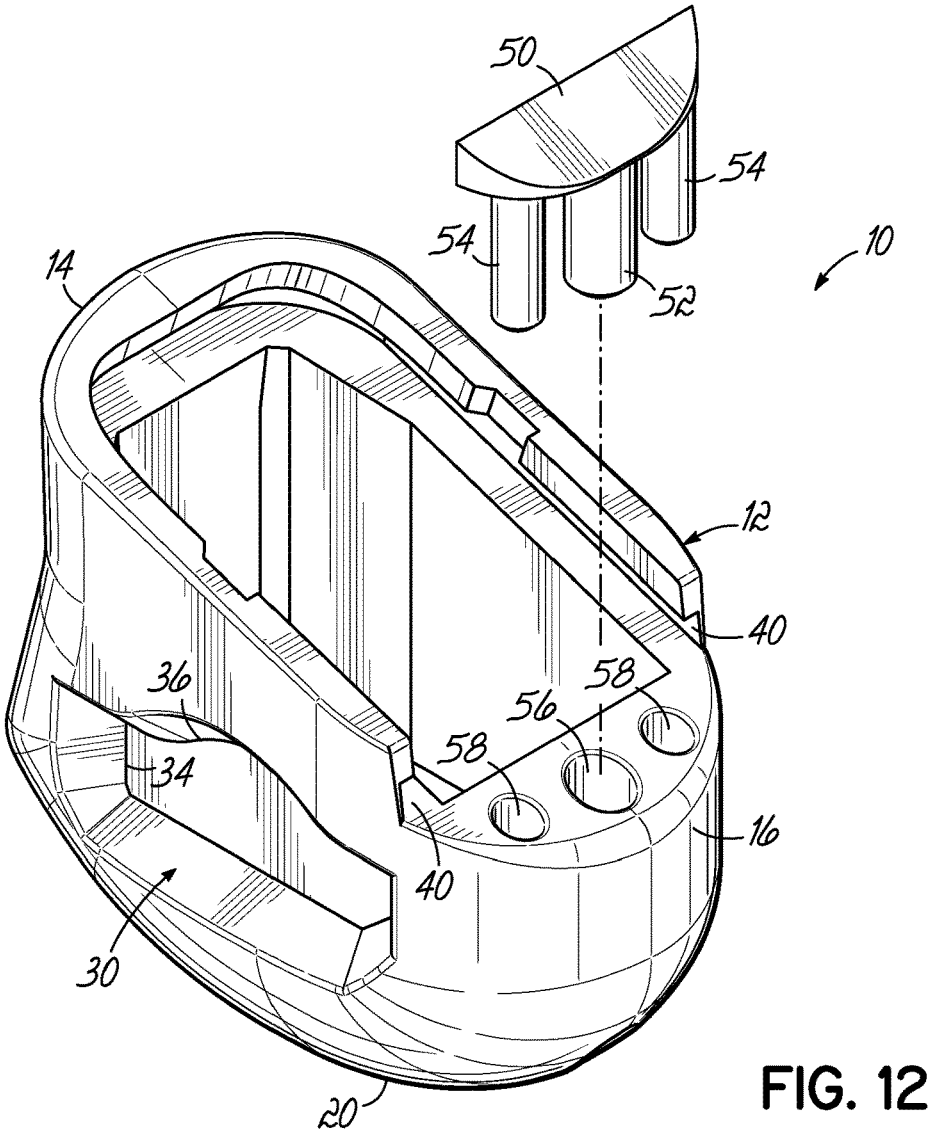
FIG. 12 is a top rear left disassembled perspective view thereof.
Figure 13A:
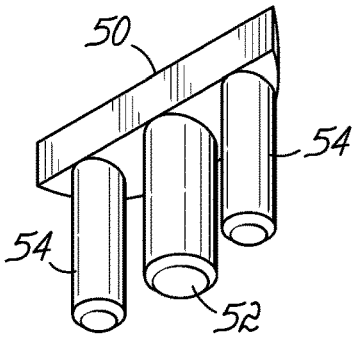
FIG. 13A is a bottom front left perspective view of the locking member thereof.
Figure 13B:
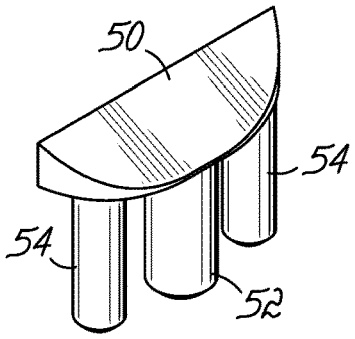
FIG. 13B is a top rear left perspective view of the locking member thereof.
Figure 15:
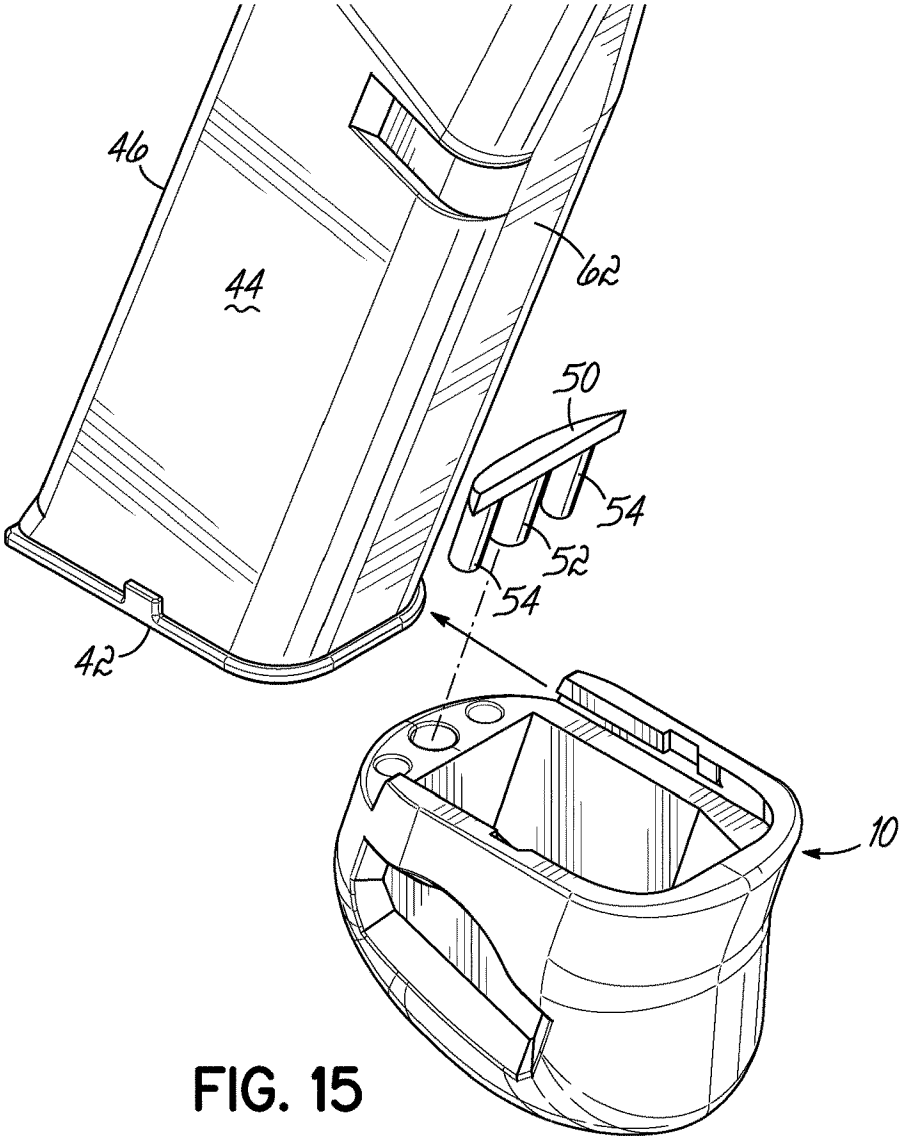
FIG. 15 is a top right front disassembled perspective view of the magazine base pad and magazine body.
Figure 14:
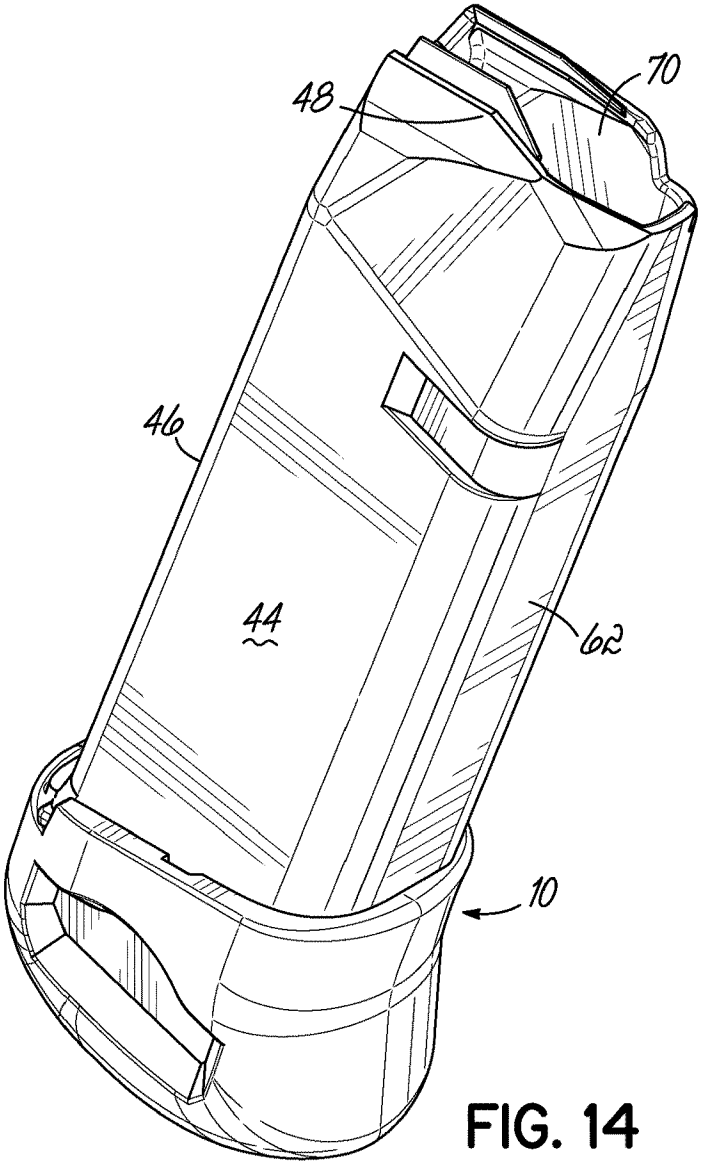
FIG. 14 is a top right front assembled perspective view of the magazine base pad and magazine body.
Figure 17:
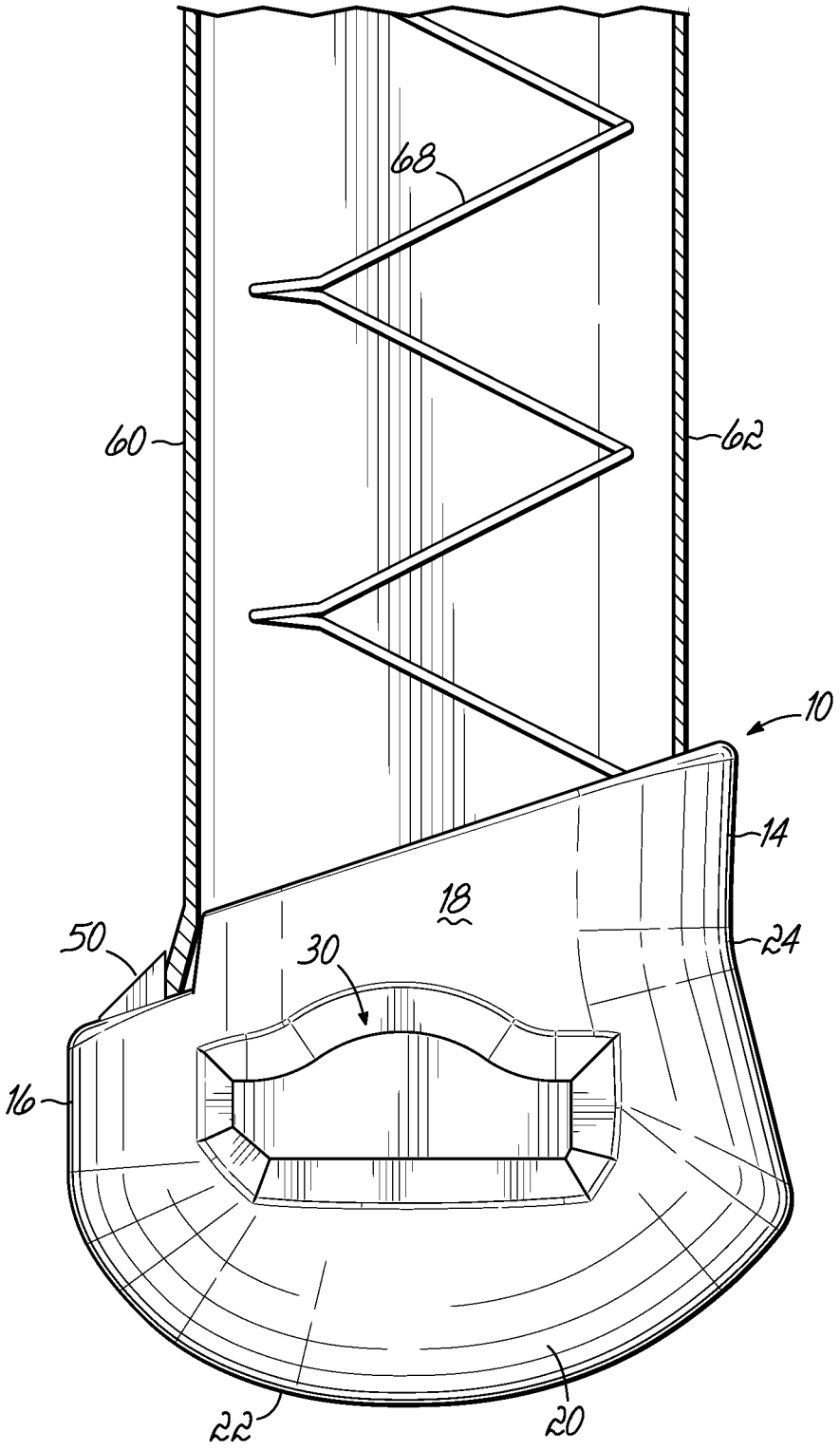
FIG. 17 is a right side view of the magazine base pad assembled onto the magazine body.

Referring first to FIGS. 1-11, there is illustrated an ergonomically shaped magazine base pad 10 according to the principles of the present invention. The magazine base pad 10 comprises a base pad body 12 and is adapted to be removably secured to a lower end of a magazine body (FIGS. 14, 15, 17). The base pad body 12 includes a front portion 14, a rear portion 16, a pair of opposed side portions 18, and a lower portion 20. As shown in FIG. 10, the lower portion 20 of the base pad body 12 is convex when viewed in a cross-sectional plane parallel to and medially of the opposed side portions 18. As shown in FIG. 11, the lower portion 20 is also convex when viewed in a cross-sectional plane perpendicular to the opposed side portions 18 and medially of the front and rear portions 14, 16. This geometry provides a rounded convex surface 22 in two planes, essentially bulbous in shape, that mates with the palm of the shooter's hand and provides continuous contact of the palm around the essentially bulbous lower portion 20 of the base pad body 12. As shown in FIG. 10, the front portion 14 of the base pad body 12 is concave when viewed in a cross-sectional plane parallel to and medially of the opposed side portions 18. This geometry provides a rounded concave surface 24 in one plane that mates with the metacarpophalangeal (MCP) joint of the shooter's index finger. These convex and concave surfaces 22, 24 can be formed either as smooth curves or from a plurality of straight or flat surfaces, adjacent ones of which are angled relative to one another, or a combination of both.

Each side portion 18 of the base pad body 12 includes a generally rectangular recess 30. The recess 30 has upper and lower longer side edges 32 and front and rear shorter side edges 34. The upper side edge 32 includes an arcuate or concave recess 36 extending upwardly therefrom.

Referring now to FIGS. 12-15 and 17, each side portion 18 of the base pad body 12 includes a channel 40 at an upper edge thereof. Channel 40 is adapted to slidably receive a flange 42 on a lower edge of a side wall 44 of the magazine body 46. A locking member 50 has at least one post extending therefrom. Preferably, locking member 50 has a larger diameter central post 52 and two smaller diameter outboard posts 54, one on each side of central post 52. Base pad body 12 has at least one hole in an upper edge of the rear portion 16. Preferably, base pad body 12 has a larger diameter central hole 56 and two smaller diameter outboard holes 58, one on each side of central hole 56. Preferably the central hole is a through hole, the purpose of which will be subsequently described. The posts 52, 54 and holes 56, 58 are preferably sized so as to create a press fit or friction fit. Once posts 52, 54 are received in holes 56, 58 and locking member 50 is pressed downwardly into contact with upper edge of rear portion 16 of base pad body 12, the locking member 50 prevents removal of the magazine body flanges 42 from the base pad body channels 40. Note that cross-sections other than circular can be used for the posts 52, 54 and holes 56, 58, as long as the cross-sections of the posts 52, 54 are complimentary to the cross-sections of the holes 56, 58 so as to create a press fit or friction fit.

The locking member 50 shown in FIGS. 12-15 is referred to as a pin bridge. It is a one-piece part that does not utilize complicated locking mechanisms nor need any screws, springs, or bolts. It can encompass any number of vertical posts with a horizontal cross brace at the top. That cross brace sits against the rear wall 60 of the magazine body 46 at a lower edge thereof to prevent the base pad body 12 from moving relative to the magazine body 46 once the cross brace is attached to the base pad body 12. The vertical post(s) fit into the corresponding holes in the rear ledge of the base pad body 12.

The posts' outer diameter matches the holes' corresponding inner diameter. Once the pin bridge 50 is installed into the base pad body 12, it is pushed down until fully seated and locked into the base pad body 12 by friction caused by a tight fit between the posts 52, 54 and receiving holes 56, 58. To remove the pin bridge 50 from the base pad body 12, a user inserts a pin punch up through the bottom end of the central through-hole 56 on the underside of the base pad body 12. One end of the punch contacts against the bottom edge of the post 52. Then, the other end of the pin punch is tapped (on a hard surface or with an impact object). The force generated loosens the pin bridge 50 upwards, unlocking it. The end user pulls it out from the top to remove it. The practical design of this pin bridge 50 effectively locks the base pad 10 onto the magazine body 46, preventing the two parts from separating.

Referring to FIGS. 14, 15, and 17, the magazine body 46 is an elongated tube with opposed side walls 44, a front wall 62, and a rear wall 60. The upper end of the magazine tube has feed lips 48 for feeding cartridges (not shown). The lower end of the magazine tube 46 may include an outwardly projecting rim, lip, or flanges 42. Flanges 42 project generally outwardly from at least the side walls 44 but may also project outwardly from the front wall 62 (as shown) or rear wall 60. As is typical, a standard or OEM base pad (not shown) includes channels that accept these flanges 42, and is held in place by an external or internal locking feature. As illustrated, magazine body 46 is that of a Glock® "double stack" or "double column" magazine. The invention, however, is not limited to Glock® double or single stack magazines, or other magazines of other pistol manufacturers, or even to pistol magazines for that matter.

These magazine body flanges 42 slide into channels 40 at the upper edges of the front portion 14 and opposed side portions 18 of the base pad body 12. As they slide into the channels, the magazine body's interior chamber aligns with the base pad's internal cavity. Due to the hollow nature of the base pad body 12, that effectively increases the length of the magazine's internal chamber. That allows the magazine spring 68 to sit lower into the base pad cavity, thereby increasing the number of cartridges that can be loaded into the magazine. Of course, the base pad body 12 could also be fabricated as a solid body, in which case it would not increase the capacity of the magazine. This is also within the scope of the invention.

Replacing a standard base pad for an increased magazine capacity base pad usually involves replacing the original magazine spring with a matching longer compression spring with additional coils that direct the follower 70 toward the upper end of the magazine tube 46 and push the cartridge (not shown) towards the feed lips 48. The magazine spring 68 is inserted into or otherwise attached to the follower's underside, biasing the follower upwardly into engagement with the feed lips 48.

Figure 16:
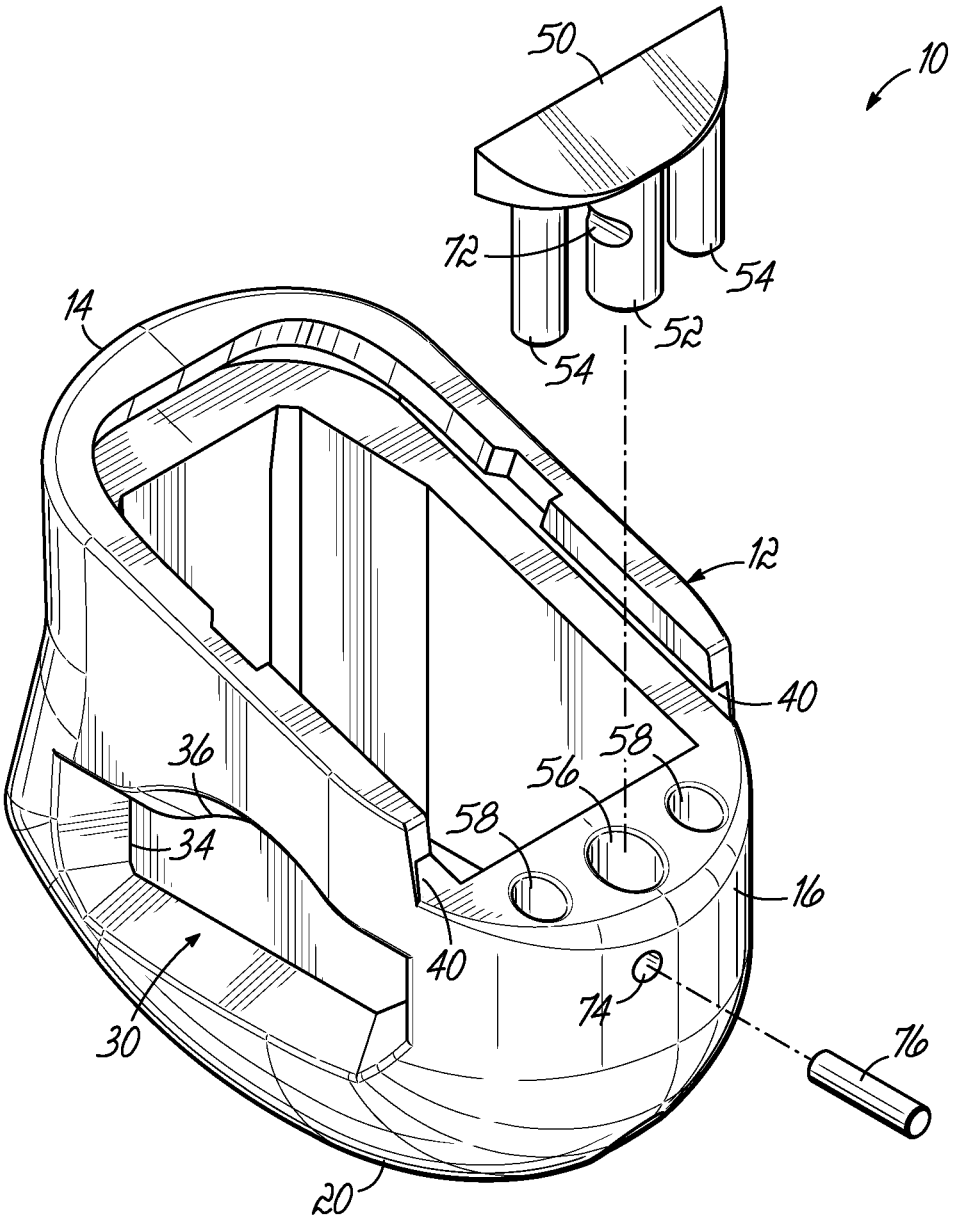
FIG. 16 is a left top rear disassembled perspective view of the base pad and an alternative embodiment of the locking member.

Referring now to FIG. 16, an alternative embodiment of the base pad 10 is illustrated. With like numbers indicating like elements in the previous embodiment, central post includes a notch 72 in a side thereof. Notch 72 aligns with a hole 74 in the rear portion 16 of the base pad body 12 once posts 52, 54 are fully seated in holes 56, 58. Pin 76 can then be pressed into hole 74, engaging notch 72. This provides a further degree of securing locking member 50 to base pad body 12. To remove the locking member 50, pin 76 is punched entirely through rear portion 16 of base pad body 12, at which time it simply drops into the internal cavity of the base pad body 12. Then, the locking member 50 is removed as in the prior embodiment.

FIGS. 18-21 illustrate the steps in withdrawing a magazine from a magazine pouch, inserting the magazine into a pistol 80, and removing the magazine from the pistol 80.

Figure 18:
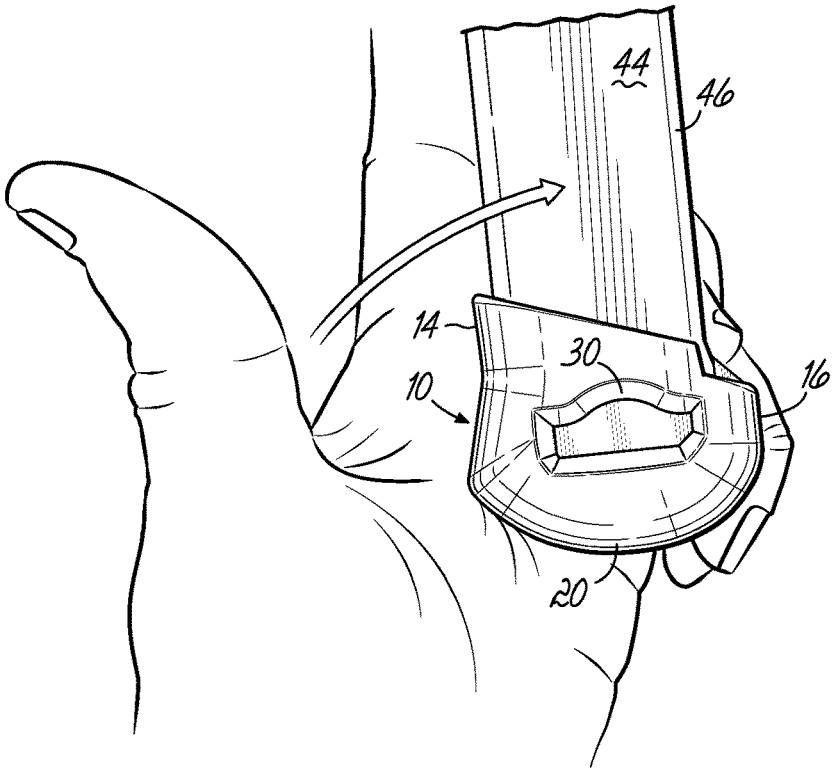
FIG. 18 is a left side view while the left-hand indexes the base pad at the metacarpophalangeal (MCP) joint of the shooter's index finger.

More particularly, FIG. 18 illustrates the left-hand indexing the base pad at the metacarpophalangeal (MCP) joint of the shooter's index finger.

Figure 19:
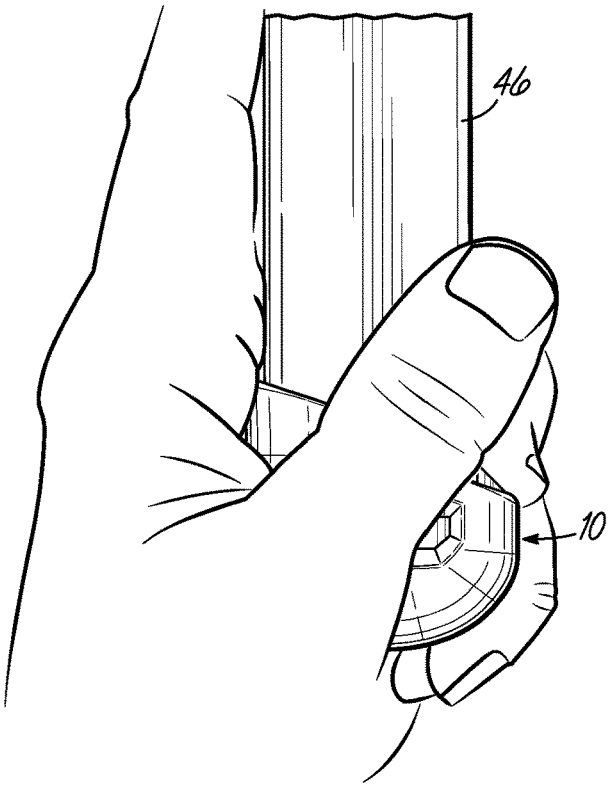
FIG. 19 is a left side view of the base pad and magazine while the left hand properly orients, wraps around, and grabs the sides and rear of the base pad.

FIG. 19 illustrates the left hand properly orienting, wrapping around, and grabbing the sides and rear of the base pad to withdraw the magazine from the pouch.

Figure 20:
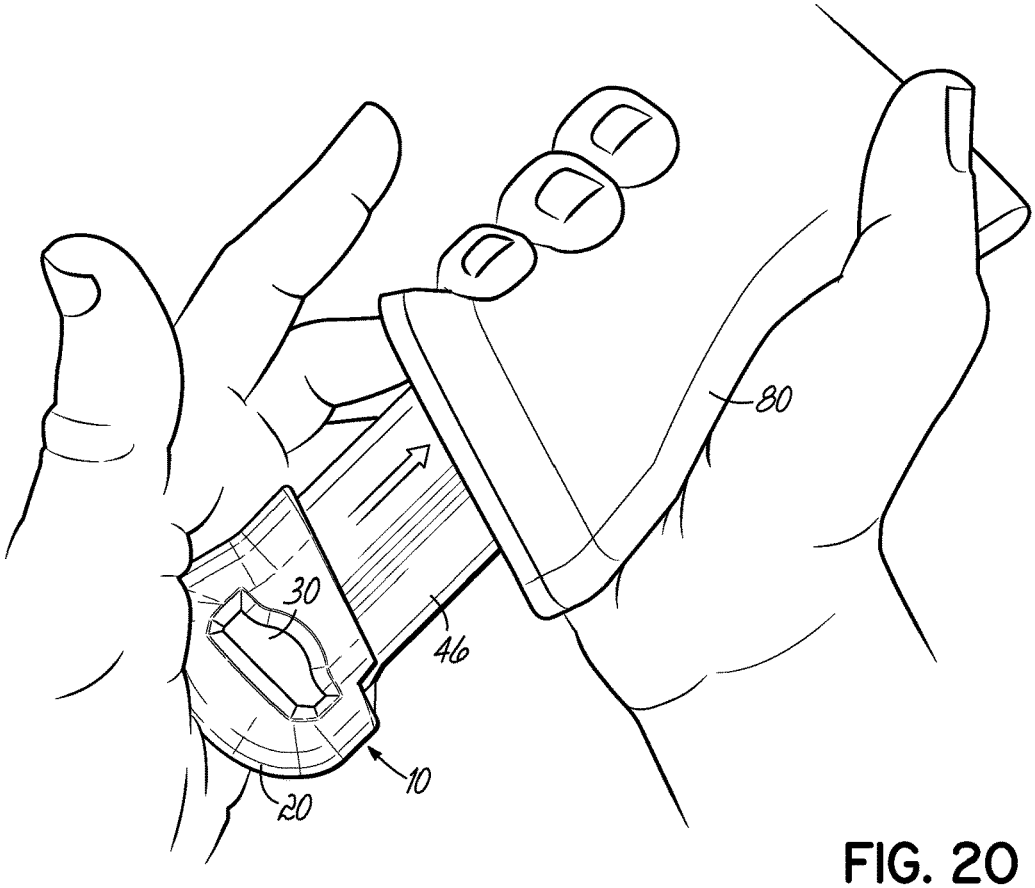
FIG. 20 is a left side view of the base pad and magazine after the left hand properly orients and inserts it into the pistol and while the left-hand moves slightly downwards and begins to rotate underneath the front lower edge of the base pad.

FIG. 20 illustrates the left hand properly orienting and inserting the magazine into the pistol 80, the left-hand moving slightly downwards and beginning to rotate underneath the front lower edge of the base pad, and the left hand continuing to rotate underneath the curved underside of the base pad and imparting upward pressure thereon.

Figure 21:
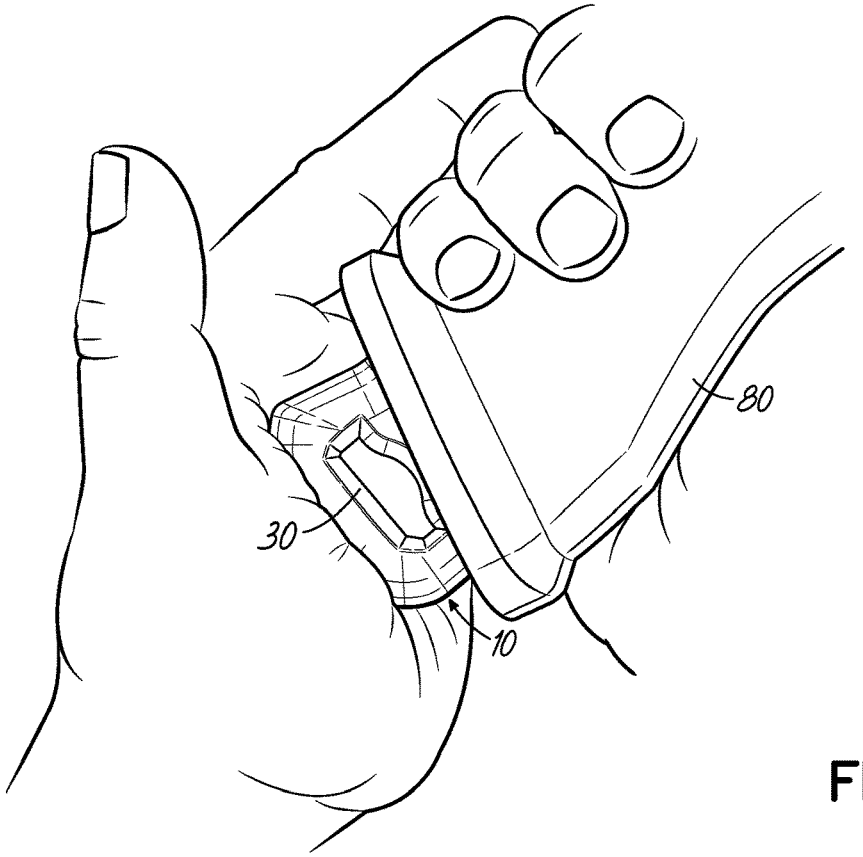
FIG. 21 is a left side view of the base pad and magazine after the left hand continues to rotate underneath the curved underside of the base pad and impart upward pressure thereon and while the left hand completes its rotation and upward pressure underneath the base pad, seating and locking the magazine into the pistol.

FIG. 21 illustrates the left hand completing its rotation and upward pressure underneath the base pad, seating and locking the magazine into the pistol 80.

Figure 22:
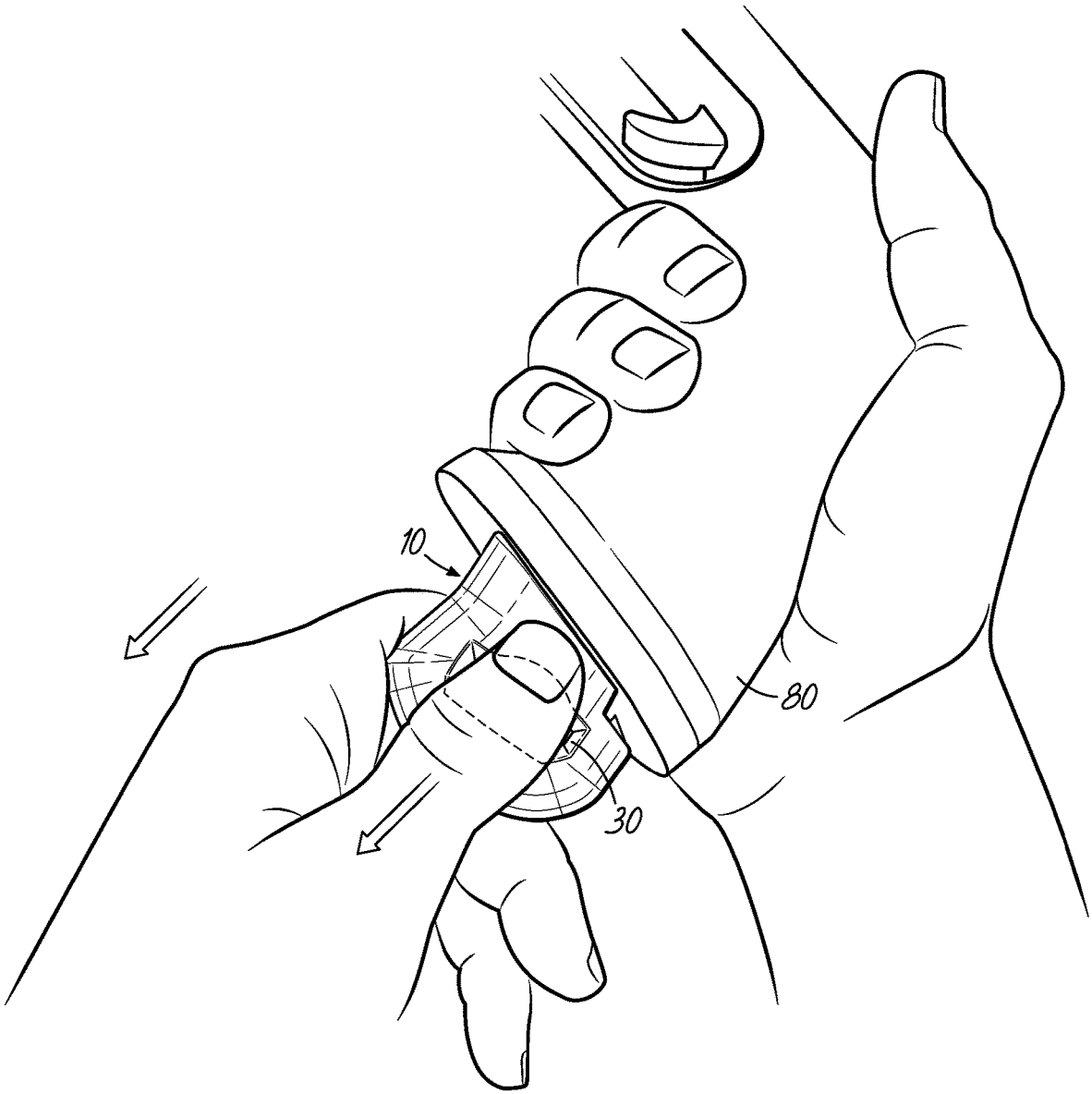
FIG. 22 is a left side view of the base pad while the thumb of the left-hand grabs the indented side area of the base pad vertically, and the index finger holds the indented area on the right side of the base pad horizontally.
Figure 23:
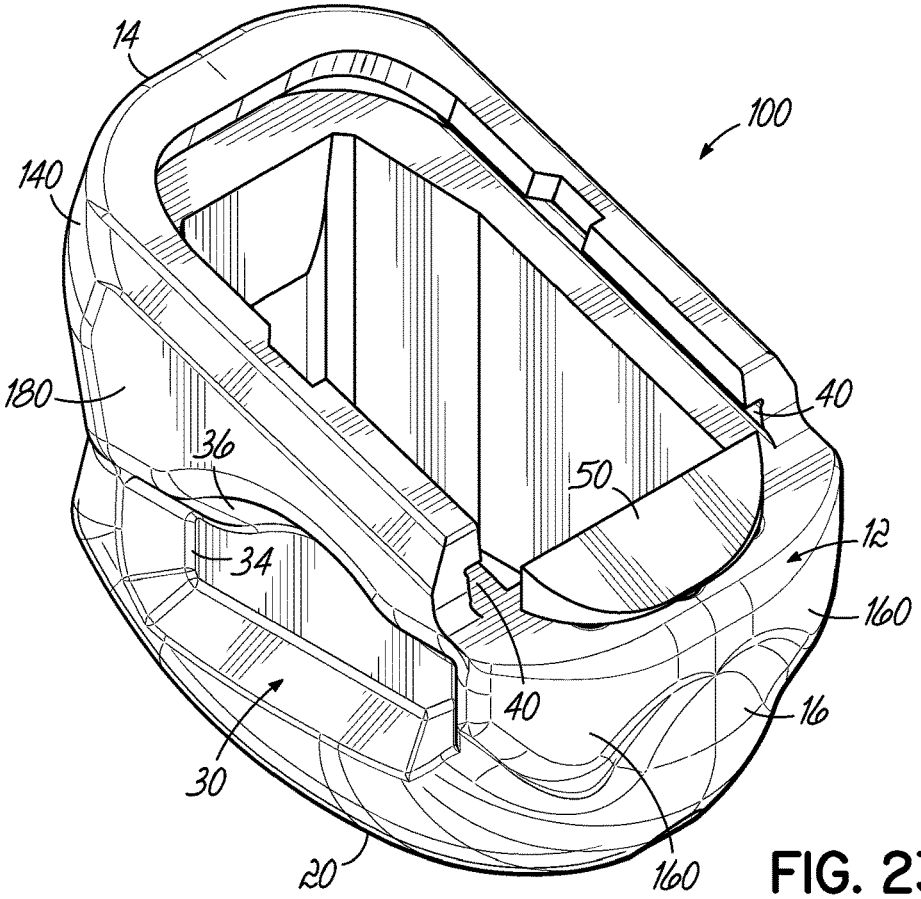
FIG. 23 is a top rear left perspective view of an alternative embodiment of the ergonomic magazine base pad of the present invention.
Figure 24:
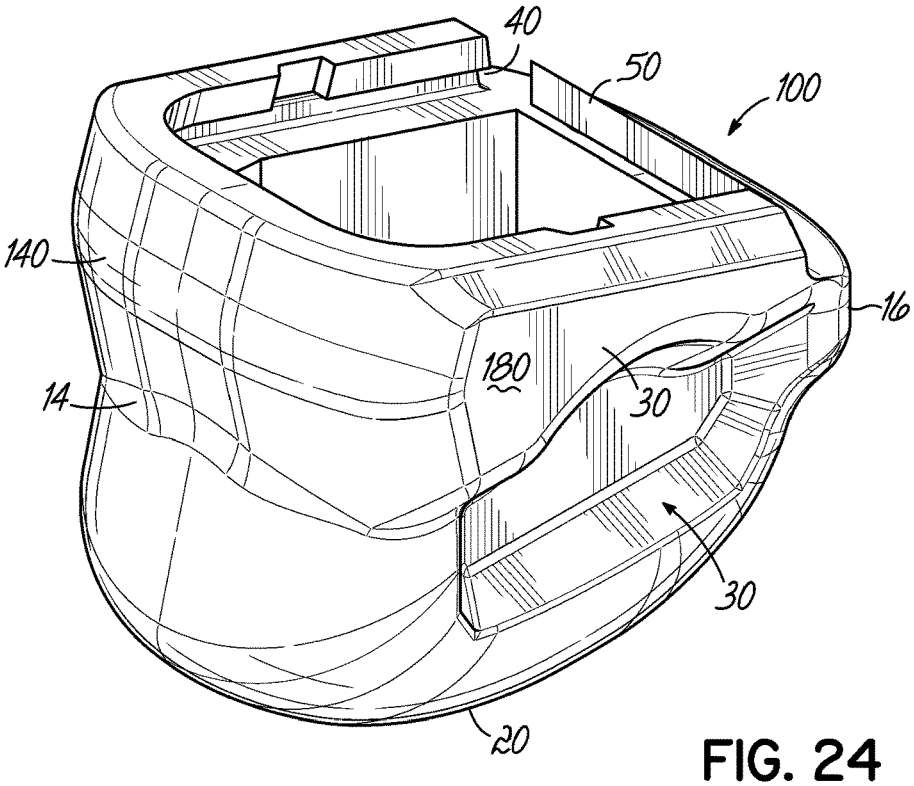
FIG. 24 is a top front left perspective view thereof.
Figure 25:
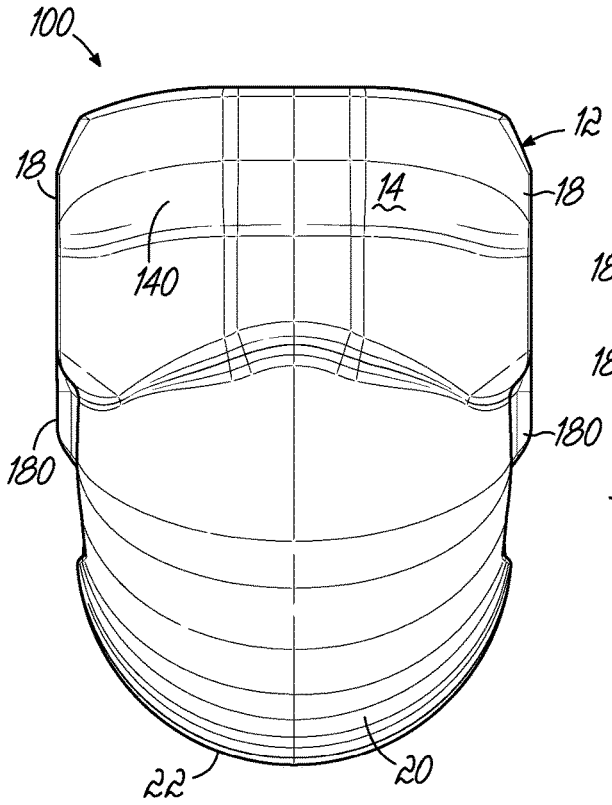
FIG. 25 is a front view thereof.
Figure 26:
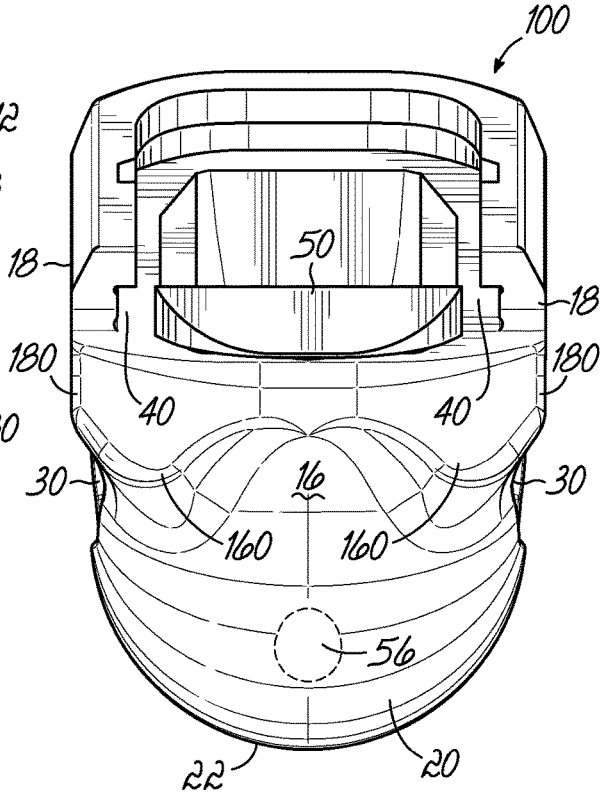
FIG. 26 is a rear view thereof.
Figure 27:
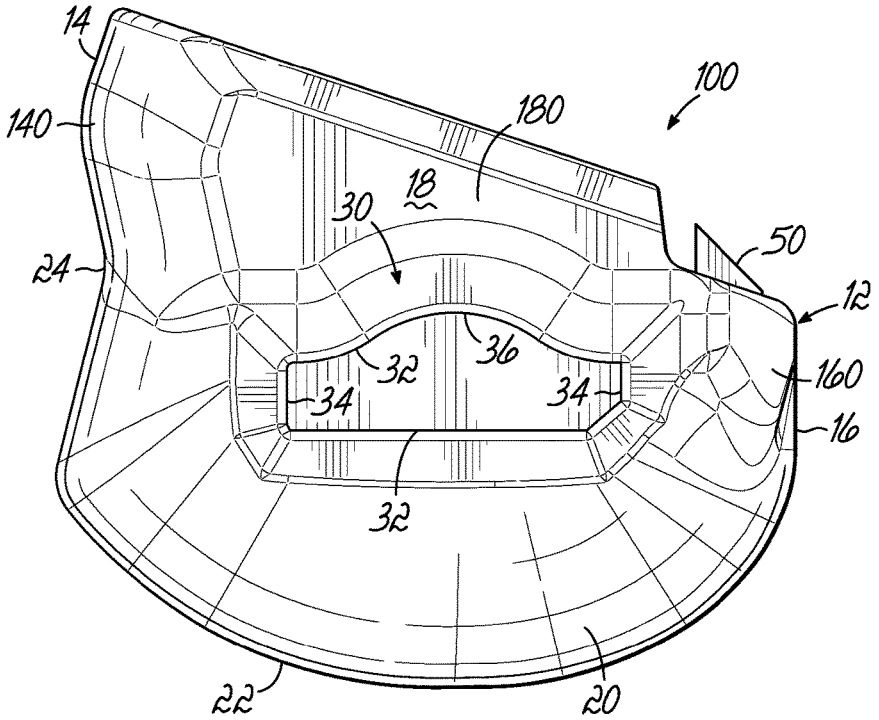
FIG. 27 is a left side view thereof, the right side view being a mirror image thereof.
Figure 28:
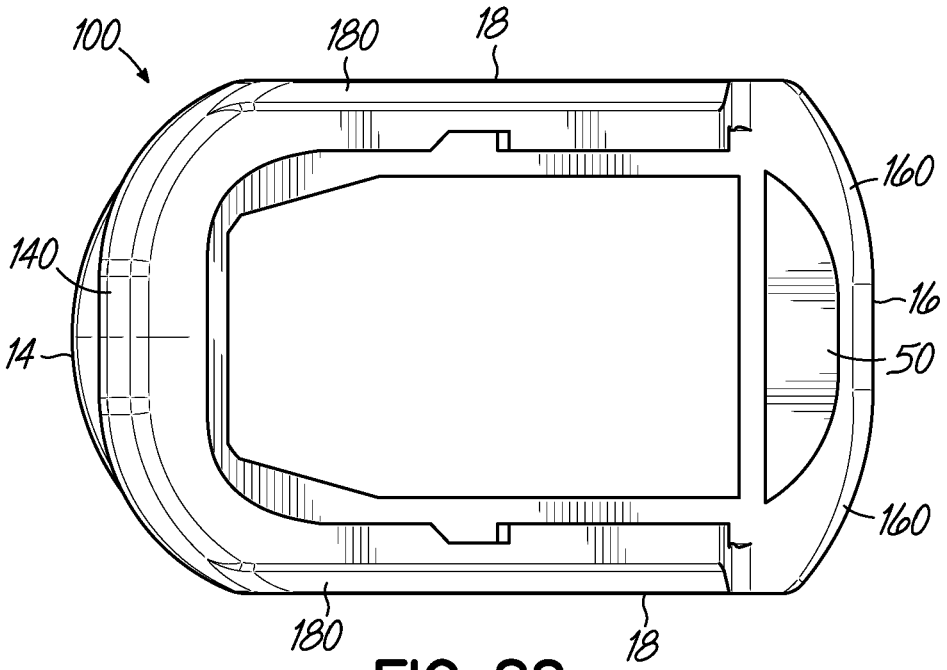
FIG. 28 is a top view thereof.
Figure 29:
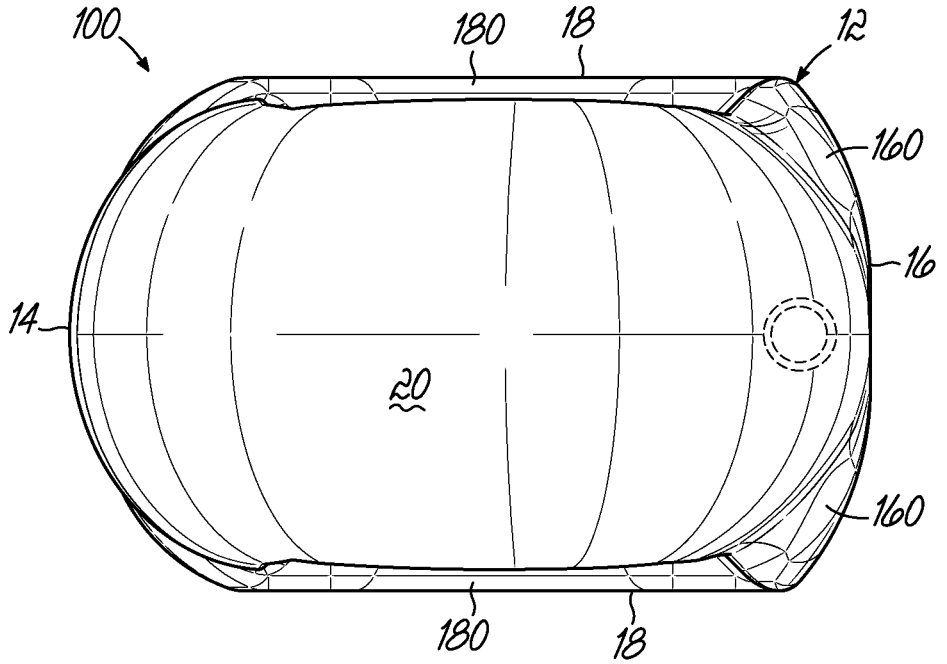
FIG. 29 is a bottom view thereof.

FIG. 22 illustrates the thumb of the left-hand grabbing the indented side area of the base pad vertically, and the index finger holding the indented area on the right side of the base pad horizontally, to withdraw the magazine from the pistol 80.

Referring now to FIGS. 23-29, there is illustrated an alternative embodiment base pad 100. Base pad 100 includes the basic features of the previous embodiment. With like numbers indicating like elements in the previous embodiment, base pad body 12 has concave front portion 14, rear portion 16, opposed side portions 18, convex lower portion 20, recesses 30, channel 40, and locking member 50. The primary difference between base pad 100 and the previous embodiment is the inclusion of thickened reinforcing areas at the upper front, upper rear, and upper sides of the base pad body 12. More particularly, base pad body 12 includes upper front thickened reinforcing portion 140, upper rear thickened reinforcing portion 160, and upper side thickened reinforcing portions 180. These portions 140, 160, and 180 provide additional strength and durability to the base pad body 12 in these regions. The various embodiments of locking member 50 discussed above and an alternative embodiment of locking member 50 discussed below can be used in conjunction with the FIGS. 23-29 alternative embodiment base pad 100.

Figure 30:
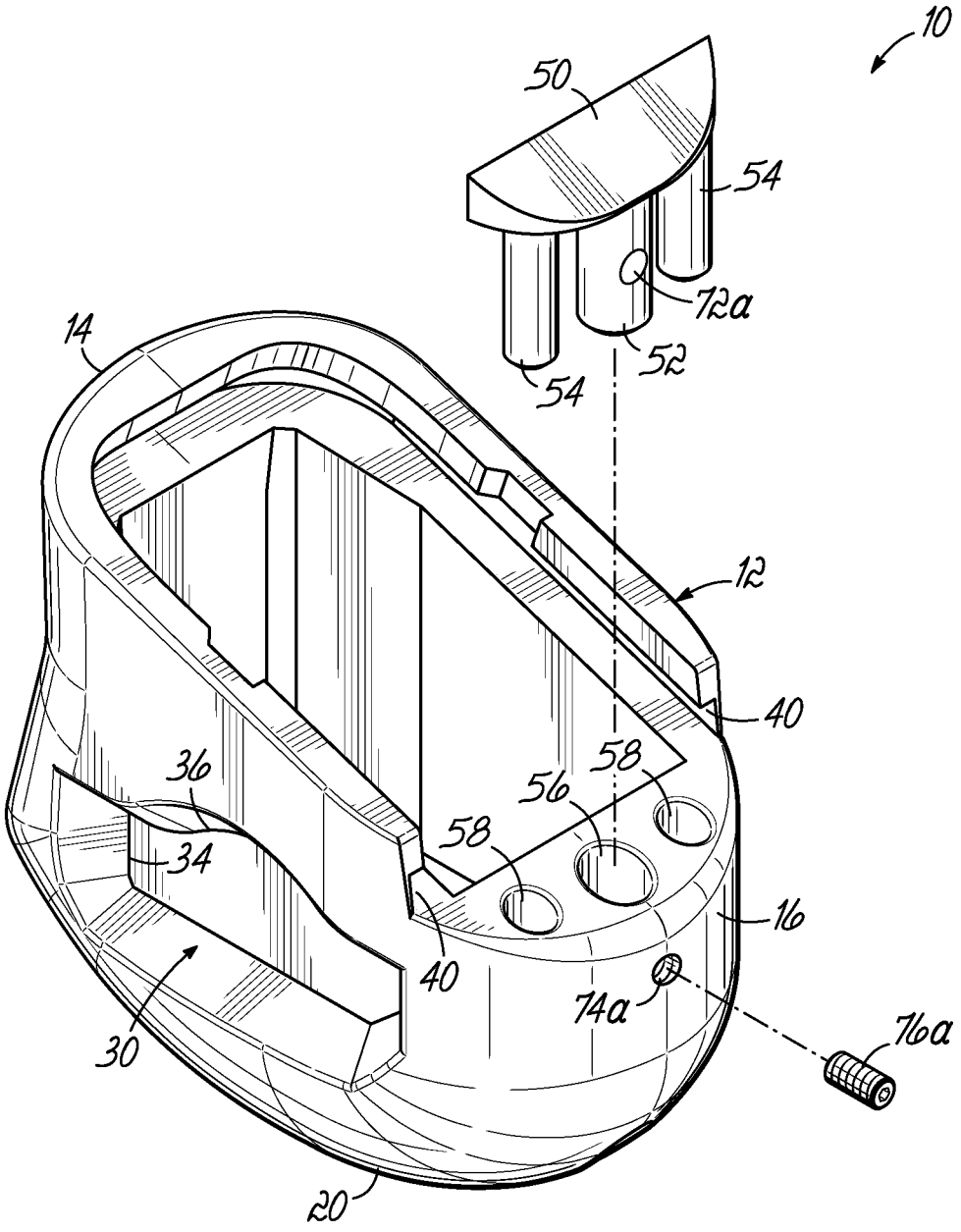
FIG. 30 is a left top rear disassembled perspective view of the base pad and an alternative embodiment of the locking member.

Referring now to FIG. 30, another alternative embodiment of the base pad 10 is illustrated. With like numbers indicating like elements in the previous embodiments, the central post 72 includes a hole 72*a* in the rear center thereof. Hole 72*a* aligns with another threaded hole 74*a* in the center rear portion of the base pad body 12 once posts 52 and 54 are fully seated in holes 56 and 58. A set screw 76*a* can then be threaded into hole 74*a*, engaging hole 72*a* in the rear of the center post 72. This provides a degree of securing locking member 50 to base pad body 12. To remove the locking member 50, set screw 76*a* is unthreaded from holes 72*a* and 74*a*. Then, the locking member 50 is removed as in the prior embodiments.

The FIG. 30 embodiment has particular application when producing base pads from metal, for example machined out of aluminum. This has particular application for high-end Military Units where their operational conditions may call for equipment that is more durable than a part made from polymer.

In this case, with a metal base pad, the 3 pin bridge locking piece that fits into the three holes on the rear shelf of the base pad, would also have to be made from metal, as it would probably not be possible for that metal bridge to be friction fit into the pin holes.

The above described alternative method that would be used to secure the metal 3 pin bridge into the metal base pad would be the small threaded socket set screw. That screw would be screwed into the hole that is in the center of the rear wall of the base pad. There would also be the small hole in the rear of the center pin of the 3 pin bridge. That would be in line with the threaded hole in the rear wall of the base pad, which holds the set screw. As the socket set screw is threadably installed into its hole (using an Allen or Hex key), the inside end of it (as the screw is fully seated into its hole) would fit into the hole that is in the rear of the center pin. The end of the set screw fitting into this hole will lock the 3 pin bridge into the base pad.

As the set screw is fully inserted into its hole, it would bottom out with the end of it securing itself into the hole on the back of the center pin. On the outside rear wall of the base pad, when the socket set screw is fully threaded in, the outside end of it (where the hex drive hole is located) would be slightly countersunk into the rear wall of the base pad.

The base pad's front section is shaped so that it matches the MCP joint of the shooter's hand. It has a contoured (rounded) front face in the upper and middle sections and a contoured lower section that is angled outwards. The front section's upper and middle areas match the MCP's joint section, and the angled-out lower area matches the side of the MCP joint that mates with the softer palm area of the shooter's hand. Additionally, with the shape of the base pad's front section having a contoured (rounded) front face in the upper and middle sections and a contoured lower section that is angled outwards, that area also matches the shape of the shooter's palm underneath the MCP joint, diagonally inwards toward the center of the palm. That inward area of the palm also fits the entire front face section of the base pad as the hand wraps around the magazine, base pad, and magazine body. That front section of the base pad's design allows the shooter to either index their MCP joint or place the base pad deeper into their palm, as they are retrieving the magazine from their magazine pouch. This design element defers to whichever reload indexing technique the shooter prefers.

The contour of the entire front section of the base pad is designed specifically to allow the shooter's hand to adjust (self-correct) at speed if it is initially misaligned with the base pad's front face as the shooter is indexing it inside of its magazine pouch.

The overall shape of the base pad is designed to match the shooter's hand as it indexes, grasps, and controls the base pad. The rounded and contoured sidewalls, lower side walls, and underside sections of the invention precisely match the shooter's hand as it performs these actions while performing a reload sequence.

The more contact points a shooter's hand has with the base pad and magazine body, the more kinesthetic sense (movement sense) that is received and processed. That is how the body and mind keep track of the magazine's position and direct its actions.

This additional feedback provided by the ergonomic design of the base pad is used continuously during a reload. It allows the end user to feel more of the base pad and magazine body. It provides them with specific input on what position those components are in relative to their body position and the pistol. This process takes place in tenths and hundredths of a second.

The base pad's design allows the shooter to orient the magazine more efficiently and effectively while performing a reload, from indexing and removing the magazine from its pouch to positioning it to be directed straight into the pistol. That increases the reliability of magazine changes.

Additionally, the base pad's design reduces the chance of over-insertion of the magazine. It also reduces the potential for physical strain-related issues. Those can be caused by using too much force when inserting, seating, and locking the magazine into the pistol.

One of the critical design elements of the invention is the lower portion of the base pad and curvature thereof. That area matches the shape and actions of the shooter's hand. As the shooter feeds the magazine into the pistol, their hand naturally rolls underneath the magazine base pad; when this occurs, the contoured underside of the invention works in conjunction and remains in contact with the contour of the shooter's palm.

In contrast, one must deal with their inherent design flaws when performing those reload actions with conventional extended magazine base pads. Those base pad designs cause a large gap between the flat underside of the conventional type base pad and the shooter's palm. Until the shooter's hand rotates completely underneath it, there is little, if any hand to surface contact on the underside of a conventional base pad.

The surface contact from the base pad provides the shooter with a specific feedback type. That allows the shooter to feel the underside of the ergonomic base pad better as they push it upwards and feed the magazine into the pistol.

This additional feedback allows them more accurately control the upward force they are applying with their support hand as they are directing the base pad.

Not having this surface contact and allowing a large gap between the hand and the underside of a conventional base pad; can lead to various issues. It can cause the shooter to misjudge the force they need when seating the magazine.

Using too much force can cause over-insertion of the magazine, which can result in malfunctions and stoppages. It can also cause something referred to as an inertial drop. That is where the force of seating the magazine moves the slide release/slide stop lever, causing the slide to be released and go forward (return to battery). This method should not be relied upon to feed and chamber a round from the reload magazine.

In addition, forcefully seating the magazine into the pistol too hard can transmit excess stress to the shooter's body. Specifically, it can add undue strain to the muscles, ligaments, and tendons of the shooter's hands, wrists, forearms, and elbows. Those forces can lead to strain-induced injuries.

The ergonomic design features of the base pad can prevent or eliminate those issues. They provide continuous contact between the shooter's hand and the base pad underside. That allows the end user to properly judge and regulate the force they apply to seat the magazine. It provides enhanced control and a faster action as part of the reload sequence.

Another key design element of the base pad is the base pad's indented side walls. Those "side grip sections" are designed for the shooter to grab and hold if and when needed. They aid the shooter in removing the magazine from the pistol. They are utilized if the magazine fails to drop free from the pistol. Or if a malfunction occurs and the magazine needs to be removed (stripped) from the pistol by force (immediate action drill).

These indented side grip sections are rectangular in shape and follow the base pad's contours. They are ambidextrous. Each grip section has a channel area along the middle and a ledge portion on the lower end of the design. That area is for the index finger of the shooter's support hand to grab horizontally. On the upper area of these grip sections, there are semi-rounded notches. Those areas are for the tip of the shooter's support hand thumb to fit.

These indented side areas work in tandem. As the shooter's index finger is on one side, on the opposing side of the base pad, the upper section of that same area allows the shooter's thumb to grab.

This grip section design allows the index finger and thumb of the support hand to grip and pinch the sides of the invention. That ergonomic design provides superior leverage and quicker action if the shooter needs to forcefully remove (pull) the magazine from the pistol.

In summary, the magazine base pad herein includes an enhanced design which improves the ergonomic shape of the magazine base pad and how it functions with the human hand. The various improvements aid the user, specifically in how they can index, grip, and manipulate the base pad and magazine. These actions are taking place while the end user is attempting to orient and insert the magazine into the weapon in a faster and more efficient manner. In addition, the ergonomic base pad has an attractive and distinctive ornamental appearance.

The various embodiments of the invention shown and described are merely for illustrative purposes only, as the drawings and the description are not intended to restrict or limit in any way the scope of the claims. Those skilled in the art will appreciate various changes, modifications, and improvements which can be made to the invention without departing from the spirit or scope thereof. The invention in its broader aspects is therefore not limited to the specific details and representative apparatus and methods shown and described. Departures may therefore be made from such details without departing from the spirit or scope of the general inventive concept. For example, specific versions of the ergonomic base pad increase the magazine's capacity by acting as an extension of the area where the ammunition is stored and fed. This is accomplished by the base pad being fabricated as essentially a hollow "shell", for example, the volume of the hollow shell adding to the volume to the magazine body to extend or increase the capacity of the magazine. However, the invention is not limited to the base pad being fabricated as a hollow shell to extend or increase the magazine capacity. For example, the base pad could be fabricated as essentially a solid body, in which case it would not add to the magazine capacity. Both versions are within the spirit and scope of the present invention. Moreover, while the ergonomic base pad has been shown and described in connection with its use on pistol magazines, it could also be used on rifle magazines. The invention resides in each individual feature described herein, alone, and in any and all combinations and subcombinations of any and all of those features. Accordingly, the scope of the invention shall be limited only by the following claims and their equivalents.

What is claimed is:

1. A firearm magazine base pad comprising:

a base pad body adapted to be removably secured to a lower end of a magazine body, the base pad body including a front portion, a rear portion, a pair of opposed side portions, and a lower portion, wherein the lower portion of the base pad body, when viewed in a cross-sectional plane parallel to and medially of the opposed side portions, is continuously convex from a forwardmost edge of the lower portion of the base pad body to a rearwardmost edge of the lower portion of the base pad body, wherein the lower portion of the base pad body, when viewed in a cross-sectional plane perpendicular to the opposed side portions and medially of the front and rear portions, is continuously convex from a leftmost edge of the lower portion of the base pad body to a rightmost edge of the lower portion of the base pad body, and wherein the front portion of the base pad body, when viewed in a cross-sectional plane parallel to and medially of the opposed side portions, is concave.

2. A firearm magazine base pad comprising:

a base pad body adapted to be removably secured to a lower end of a magazine body, the base pad body including a front portion, a rear portion, a pair of opposed side portions, and a lower portion, wherein the lower portion of the base pad body, when viewed in a cross-sectional plane parallel to and medially of the opposed side portions, is convex, wherein the lower portion of the base pad body, when viewed in a cross-sectional plane perpendicular to the opposed side portions and medially of the front and rear portions, is convex, and wherein the front portion of the base pad body, when viewed in a cross-sectional plane parallel to and medially of the opposed side portions, is concave, wherein each side portion of the base pad body includes a generally rectangular recess therein, the recess having upper and lower longer side edges and front and rear shorter side edges, the upper side edge including an arcuate recess extending upwardly therefrom.

3. A firearm magazine base pad comprising:

a base pad body adapted to be removably secured to a lower end of a magazine body, the base pad body including a front portion, a rear portion, a pair of opposed side portions, and a lower portion, wherein the lower portion of the base pad body, when viewed in a cross-sectional plane parallel to and medially of the opposed side portions, is convex, wherein the lower portion of the base pad body, when viewed in a cross-sectional plane perpendicular to the opposed side portions and medially of the front and rear portions, is convex, and wherein the front portion of the base pad body, when viewed in a cross-sectional plane parallel to and medially of the opposed side portions, is concave, wherein each side portion of the base pad body includes a channel at an upper edge thereof adapted to slidably receive a flange on a lower edge of a side wall of the magazine body, the magazine base pad further comprising:

a locking member having at least one post extending therefrom, and the base pad body having at least one hole in an upper edge of the rear portion thereof, the post received in the hole whereby the locking member prevents removal of the magazine body flanges from the base pad body channels.

4. A firearm magazine base pad comprising:

a base pad body adapted to be removably secured to a lower end of a magazine body, the base pad body including a front portion, a rear portion, a pair of opposed side portions, and a lower portion, wherein the lower portion of the base pad body, when viewed in a cross-sectional plane parallel to and medially of the opposed side portions, is convex, wherein the lower portion of the base pad body, when viewed in a cross-sectional plane perpendicular to the opposed side portions and medially of the front and rear portions, is convex, and wherein the front portion of the base pad body, when viewed in a cross-sectional plane parallel to and medially of the opposed side portions, is concave, wherein each side portion of the base pad body includes a generally rectangular recess therein, the recess having upper and lower longer side edges and front and rear shorter side edges, the upper side edge including an arcuate recess extending upwardly therefrom, and wherein each side portion of the base pad body includes a channel at an upper edge thereof adapted to slidably receive a flange on a lower edge of a side wall of the magazine body, the magazine base pad further comprising:

a locking member having at least one post extending therefrom, and the base pad body having at least one hole in an upper edge of the rear portion thereof, the post received in the hole whereby the locking member prevents removal of the magazine body flanges from the base pad body channels.

5. A firearm magazine base pad comprising:

a base pad body adapted to be removably secured to a lower end of a magazine body, the base pad body including a front portion, a rear portion, a pair of opposed side portions, and a lower portion, wherein each side portion of the base pad body includes a generally rectangular recess, the recess having upper and lower longer side edges and front and rear shorter side edges, the upper side edge including an arcuate recess extending upwardly therefrom.

6. The magazine base pad of claim 5 wherein the lower portion of the base pad body, when viewed in a cross-sectional plane parallel to and medially of the opposed side portions, is convex.

7. The magazine base pad of claim 5 wherein the lower portion of the base pad body, when viewed in a cross-sectional plane perpendicular to the opposed side portions and medially of the front and rear portions, is convex.

8. The magazine base pad of claim 5 wherein the front portion of the base pad body, when viewed in a cross-sectional plane parallel to and medially of the opposed side portions, is concave.

9. The magazine base pad of claim 5 wherein each side portion of the base pad body includes a channel at an upper edge thereof adapted to slidably receive a flange on a lower edge of a side wall of the magazine body, the magazine base pad further comprising:

a locking member having at least one post extending therefrom, and the base pad body having at least one hole in an upper edge of the rear portion thereof, the post received in the hole whereby the locking member prevents removal of the magazine body flanges from the base pad body channels.

10. A firearm magazine base pad comprising:

a base pad body adapted to be removably secured to a lower end of a magazine body, the base pad body including a front portion, a rear portion, a pair of opposed side portions, and a lower portion, each side portion of the base pad body including a channel at an upper edge thereof adapted to slidably receive a flange on a lower edge of a side wall of the magazine body, a locking member having a cross brace and at least one post extending downwardly therefrom, and the base pad body having at least one hole in an upper edge of the rear portion thereof, the post received in the hole and a lowermost surface of the cross brace abutting the upper edge of the rear portion of the base pad body whereby the locking member prevents removal of the magazine body flanges from the base pad body channels.

11. A firearm magazine base pad comprising:

a base pad body adapted to be removably secured to a lower end of a magazine body, the base pad body including a front portion, a rear portion, a pair of opposed side portions, and a lower portion, each side portion of the base pad body including a channel at an upper edge thereof adapted to slidably receive a flange on a lower edge of a side wall of the magazine body, a locking member having at least one post extending therefrom, and the base pad body having at least one hole in an upper edge of the rear portion thereof, the post received in the hole whereby the locking member prevents removal of the magazine body flanges from the base pad body channels, wherein the lower portion of the base pad body, when viewed in a cross-sectional plane parallel to and medially of the opposed side portions, is convex.

12. A firearm magazine base pad comprising:

a base pad body adapted to be removably secured to a lower end of a magazine body, the base pad body including a front portion, a rear portion, a pair of opposed side portions, and a lower portion, each side portion of the base pad body including a channel at an upper edge thereof adapted to slidably receive a flange on a lower edge of a side wall of the magazine body, a locking member having at least one post extending therefrom, and the base pad body having at least one hole in an upper edge of the rear portion thereof, the post received in the hole whereby the locking member prevents removal of the magazine body flanges from the base pad body channels, wherein the lower portion of the base pad body, when viewed in a cross-sectional plane perpendicular to the opposed side portions and medially of the front and rear portions, is convex.

13. The magazine base pad of claim 10 wherein the front portion of the base pad body, when viewed in a cross-sectional plane parallel to and medially of the opposed side portions, is concave.

14. A firearm magazine base pad comprising:

a base pad body adapted to be removably secured to a lower end of a magazine body, the base pad body including a front portion, a rear portion, a pair of opposed side portions, and a lower portion, wherein the lower portion of the base pad body, when viewed in a cross-sectional plane parallel to and medially of the opposed side portions, is continuously convex from a forwardmost edge of the lower portion of the base pad body to a rearwardmost edge of the lower portion of the base pad body, and wherein the lower portion of the base pad body, when viewed in a cross-sectional plane perpendicular to the opposed side portions and medially of the front and rear portions, is continuously convex from a leftmost edge of the lower portion of the base pad body to a rightmost edge of the lower portion of the base pad body.

15. A firearm magazine base pad comprising:

a base pad body adapted to be removably secured to a lower end of a magazine body, the base pad body including a front portion, a rear portion, a pair of opposed side portions, and a lower portion, wherein the lower portion of the base pad body, when viewed in a cross-sectional plane parallel to and medially of the opposed side portions, is convex, and wherein the lower portion of the base pad body, when viewed in a cross-sectional plane perpendicular to the opposed side portions and medially of the front and rear portions, is convex, wherein each side portion of the base pad body includes a generally rectangular recess therein, the recess having upper and lower longer side edges and front and rear shorter side edges, the upper side edge including an arcuate recess extending upwardly therefrom.

16. A firearm magazine base pad comprising:

a base pad body adapted to be removably secured to a lower end of a magazine body, the base pad body including a front portion, a rear portion, a pair of opposed side portions, and a lower portion, wherein the lower portion of the base pad body, when viewed in a cross-sectional plane parallel to and medially of the opposed side portions, is convex, and wherein the lower portion of the base pad body, when viewed in a cross-sectional plane perpendicular to the opposed side portions and medially of the front and rear portions, is convex, wherein each side portion of the base pad body includes a channel at an upper edge thereof adapted to slidably receive a flange on a lower edge of a side wall of the magazine body, the magazine base pad further comprising:

a locking member having at least one post extending therefrom, and the base pad body having at least one hole in an upper edge of the rear portion thereof, the post received in the hole whereby the locking member prevents removal of the magazine body flanges from the base pad body channels.

17. A firearm magazine base pad comprising:

a base pad body adapted to be removably secured to a lower end of a magazine body, the base pad body including a front portion, a rear portion, a pair of opposed side portions, and a lower portion, wherein the lower portion of the base pad body, when viewed in a cross-sectional plane parallel to and medially of the opposed side portions, is convex, and wherein the lower portion of the base pad body, when viewed in a cross-sectional plane perpendicular to the opposed side portions and medially of the front and rear portions, is convex, wherein each side portion of the base pad body includes a generally rectangular recess therein, the recess having upper and lower longer side edges and front and rear shorter side edges, the upper side edge including an arcuate recess extending upwardly therefrom, and wherein each side portion of the base pad body includes a channel at an upper edge thereof adapted to slidably receive a flange on a lower edge of a side wall of the magazine body, the magazine base pad further comprising:

a locking member having at least one post extending therefrom, and the base pad body having at least one hole in an upper edge of the rear portion thereof, the post received in the hole whereby the locking member prevents removal of the magazine body flanges from the base pad body channels.

* * * * *